US011705142B2

(12) United States Patent
Sung

(10) Patent No.: US 11,705,142 B2
(45) **Date of Patent: *Jul. 18, 2023**

(54) SIGNAL ENCODING METHOD AND DEVICE AND SIGNAL DECODING METHOD AND DEVICE

(71) Applicant: SAMSUNG ELECTRONICS CO., LTD., Suwon-si (KR)

(72) Inventor: Ho-sang Sung, Yongin-si (KR)

(73) Assignee: SAMSUNG ELECTRONIC CO., LTD., Suwon-si (KR)

( * ) Notice: Subject to any disclaimer, the term of this patent is extended or adjusted under 35 U.S.C. 154(b) by 315 days.

This patent is subject to a terminal disclaimer.

(21) Appl. No.: 17/060,888

(22) Filed: Oct. 1, 2020

(65) Prior Publication Data

US 2021/0020184 A1 Jan. 21, 2021

Related U.S. Application Data

(63) Continuation of application No. 16/282,677, filed on Feb. 22, 2019, now Pat. No. 10,811,019, which is a (Continued)

(51) Int. Cl.
*G10L 19/032* (2013.01)
*G10L 19/035* (2013.01)
*G10L 19/02* (2013.01)

(52) U.S. Cl.
CPC ..... *G10L 19/0204* (2013.01); *G10L 19/032* (2013.01); *G10L 19/035* (2013.01)

(58) Field of Classification Search
CPC .. G10L 19/0204; G10L 19/032; G10L 19/035
See application file for complete search history.

(56) References Cited

U.S. PATENT DOCUMENTS 4,975,956 A 12/1990 Liu
5,369,724 A 11/1994 Lim
(Continued)

FOREIGN PATENT DOCUMENTS

CN 1524348 A 8/2004
CN 101836251 A 9/2010
(Continued)

OTHER PUBLICATIONS

Juan Meng, et al., "A New Wavelet Fractal Hybrid Image Coding Method", Microprocessor, Issue 1, Feb. 28, 2008, pp. 44-46.
(Continued)

*Primary Examiner* — Bryan S Blankenagel
(74) *Attorney, Agent, or Firm* — Sughrue Mion, PLLC

(57) ABSTRACT

A spectrum encoding method includes selecting an important spectral component in band units for a normalized spectrum and encoding information of the selected important spectral component for a band, based on a number, a position, a magnitude and a sign thereof. A spectrum decoding method includes obtaining from a bitstream, information about an important spectral component for a band of an encoded spectrum and decoding the obtained information of the important spectral component, based on a number, a position, a magnitude and a sign of the important spectral component.

6 Claims, 19 Drawing Sheets

Related U.S. Application Data continuation of application No. 15/022,406, filed as application No. PCT/KR2014/008627 on Sep. 16, 2014, now Pat. No. 10,388,293.

(60) Provisional application No. 61/878,172, filed on Sep. 16, 2013.

(56) References Cited

U.S. PATENT DOCUMENTS

| | | | | |
|---|---|---|---|---|
| 6,529,604 | B1 * | 3/2003 | Park | H04H 20/88 381/23 |
| 6,539,122 | B1 * | 3/2003 | Abousleman | G06T 9/007 382/250 |
| 6,847,684 | B1 | 1/2005 | Hsu | |
| 6,930,618 | B2 | 8/2005 | Touyama et al. | |
| 7,336,720 | B2 | 2/2008 | Martemyanov | |
| 7,605,727 | B2 | 10/2009 | Sung et al. | |
| 7,944,377 | B2 | 5/2011 | Sung et al. | |
| 7,965,206 | B2 | 6/2011 | Choo et al. | |
| 8,515,767 | B2 | 8/2013 | Reznik | |
| 8,527,265 | B2 | 9/2013 | Reznik et al. | |
| 8,612,215 | B2 | 12/2013 | Son et al. | |
| 8,615,391 | B2 | 12/2013 | Kim et al. | |
| 9,076,434 | B2 | 7/2015 | Yamanashi et al. | |
| 9,418,670 | B2 | 8/2016 | Matsumura et al. | |
| 9,466,308 | B2 | 10/2016 | Choo et al. | |
| 9,472,199 | B2 | 10/2016 | Lee et al. | |
| 9,858,934 | B2 | 1/2018 | Porov et al. | |
| 10,109,283 | B2 | 10/2018 | Kim et al. | |
| 10,229,692 | B2 | 3/2019 | Sung et al. | |
| 10,811,022 | B2 | 10/2020 | Choo et al. | |
| 2001/0016811 | A1 | 8/2001 | Thyssen | |
| 2003/0061055 | A1 | 3/2003 | Taori et al. | |
| 2003/0108248 | A1 | 6/2003 | Huang | |
| 2004/0049379 | A1 | 3/2004 | Thumpudi | |
| 2006/0136198 | A1 | 6/2006 | Kim et al. | |
| 2007/0016404 | A1 | 1/2007 | Kim et al. | |
| 2007/0016406 | A1 | 1/2007 | Thumpudi et al. | |
| 2007/0168197 | A1 * | 7/2007 | Vasilache | G10L 19/032 704/503 |
| 2007/0172071 | A1 | 7/2007 | Mehrotra | |
| 2007/0174062 | A1 | 7/2007 | Mehrotra | |
| 2008/0052066 | A1 * | 2/2008 | Oshikiri | G10L 21/038 704/E21.011 |
| 2008/0126082 | A1 * | 5/2008 | Ehara | G10L 21/038 704/E19.044 |
| 2008/0219466 | A1 | 9/2008 | Pishehvar | |
| 2009/0030678 | A1 | 1/2009 | Kovesi et al. | |
| 2009/0135946 | A1 | 5/2009 | Dowling et al. | |
| 2009/0167588 | A1 | 7/2009 | Sung | |
| 2009/0234644 | A1 | 9/2009 | Reznik et al. | |
| 2009/0271204 | A1 | 10/2009 | Tammi | |
| 2010/0232507 | A1 | 9/2010 | Cho et al. | |
| 2010/0241433 | A1 | 9/2010 | Herre et al. | |
| 2011/0004469 | A1 | 1/2011 | Sato et al. | |
| 2012/0278086 | A1 | 11/2012 | Fuchs | |
| 2012/0290307 | A1 | 11/2012 | Kim et al. | |
| 2013/0030796 | A1 | 1/2013 | Liu | |
| 2013/0110522 | A1 | 5/2013 | Choo et al. | |
| 2013/0144632 | A1 | 6/2013 | Sung | |
| 2013/0279576 | A1 * | 10/2013 | Chen | H04N 19/70 375/240.12 |
| 2013/0290003 | A1 | 10/2013 | Choo | |
| 2014/0200901 | A1 * | 7/2014 | Kawashima | G10L 21/0388 704/500 |
| 2014/0236581 | A1 | 8/2014 | Lee et al. | |
| 2014/0303965 | A1 | 10/2014 | Lee | |
| 2019/0013019 | A1 | 1/2019 | Lawrence | |
| 2020/0135219 | A1 | 4/2020 | Qi et al. | |
| 2021/0090581 | A1 | 3/2021 | Choo et al. | |

FOREIGN PATENT DOCUMENTS

| | | | |
|---|---|---|---|
| CN | 101849258 | A | 9/2010 |
| CN | 102208188 | A | 10/2011 |
| CN | 102460570 | A | 5/2012 |
| CN | 102467910 | A | 5/2012 |
| CN | 102947881 | A | 2/2013 |
| CN | 103106902 | A | 5/2013 |
| CN | 103650038 | A | 3/2014 |
| CN | 103733257 | A | 4/2014 |
| CN | 103946918 | A | 7/2014 |
| EP | 3 046 104 | A1 | 7/2016 |
| EP | 3 109 611 | A1 | 12/2016 |
| EP | 3 176 780 | A1 | 6/2017 |
| JP | 2009501359 | A | 1/2009 |
| JP | 2009-530960 | A | 8/2009 |
| JP | 2009193015 | A | 8/2009 |
| JP | 2011501828 | A | 1/2011 |
| JP | 6243540 | B2 | 12/2017 |
| KR | 10-0851970 | B1 | 8/2008 |
| KR | 10-2008-0092770 | A | 10/2008 |
| KR | 10-0868763 | B1 | 11/2008 |
| KR | 10-2009-0070554 | A | 7/2009 |
| KR | 10-2010-0035955 | A | 4/2010 |
| KR | 10-2012-0028791 | A | 3/2012 |
| KR | 10-2012-0120085 | A | 11/2012 |
| KR | 10-2013-0044193 | A | 5/2013 |
| WO | 2007/011657 | A2 | 1/2007 |
| WO | 2009/055493 | A1 | 4/2009 |
| WO | 2013/048171 | A2 | 4/2013 |

OTHER PUBLICATIONS

Communication dated Mar. 28, 2018, issued by the European Patent Office in counterpart European Patent Application No. 14844614.9.

Communication dated Aug. 28, 2018 issued by the Japanese Patent Office in counterpart Japanese Application No. 2017-216718.

"3rd Generation Partnership Project; Technical Specification Group Services and System Aspects; Codec for Enhanced Voice Services (EVS); Detailed Algorithmic Description (Release 12)", 5.3 MDCT Coding Mode, 3GPP TS 26.445, V1.0.0, Sep. 2014, pp. 270-407, 139 pages total, XP050925374.

Communication dated May 28, 2019 issued by the State Intellectual Property Office of P.R. China in counterpart Chinese Application No. 201480062625.9.

International Search Report for PCT/KR2014/008627 dated Dec. 1, 2014 [PCT/ISA/210].

Communication dated Dec. 19, 2018, issued by the National Intellectual Property Administration, PRC in counterpart Chinese Application No. 201480062625.9.

Siling Wei, "An Efficient Fractional Image Coding Technology", Journal of Henan University (Natural Science), vol. 30, No. 3, Sep. 30, 2020, pp. 78-82.

ITU-T G.719, "Low-complexity, full-band audio coding for high-quality, conversational applications", Jun. 2008, total 58 pages.

Communication dated Feb. 8, 2017 issued by the European Patent Office in counterpart Application No. 14844614.9.

Sibing Wei, et al., "A New Fractal Image Compression Approach", ACTA Scientiarum Naturalium Universitatis Sunyatseni, vol. 37, Jun. 30, 1998, pp. 19-24.

Written Opinion for PCT/KR2014/008627 dated Dec. 1, 2014 [PCT/ISA/237].

Communication dated Jun. 6, 2017, issued by the Japanese Patent Office in counterpart Japanese Application No. 2016-542652.

Communication dated Dec. 10, 2019 issued by the European Intellectual Property Office in counterpart European Application No. 19201221.9.

Communication dated Jan. 5, 2021 issued by the Korean Intellectual Property Office in Korean Application No. 10-2014-0123057.

"Frame error robust narrow-band and wideband embedded variable bit-rate coding of speech and audio from 8-32 kbit/s", Series G: Transmission Systems and Media, Digital Systems and Networks, Digital terminal equipments—Coding of voice and audio signals,

(56) References Cited

OTHER PUBLICATIONS

Recommendation ITU-T, G.718, ITU-T, Telecommunication Standardization Sector of ITU, Jun. 2008, 257 total pages.
Communication dated Apr. 8, 2022 by the Korean Intellectual Property Office in Korean Patent Application No. 10-2017-7002772.
Communication (EP Decision to Refuse) dated Apr. 11, 2022 by the European Patent Office in European Patent Application No. 19201221.9.
Communication (EP Minutes to Oral Proceedings) issued Apr. 11, 2022 by the European Patent Office in European Patent Application No. 19201221.9.
Communication dated Jul. 15, 2021, issued by the Korean Intellectual Property Office in Korean Patent Application No. 10-2014-0123057.
Communication dated Feb. 18, 2022, issued by the Korean Intellectual Property Office in Korean Patent Application No. 10-2021-0081049.
Quackenbush et al., "Noiseless Coding of Quantized Spectral Components in MPEG-2 Advanced Audio Coding," IEEE 1997 Workshop on Applications of Signal Processing to Audio and Acoustics, 1997, Total 4 pages.
Communication dated Jan. 12, 2022, issued by Intellectual Property India in Indian Patent Application No. 202028056627.
Communication dated Oct. 21, 2022 issued by the Korean Intellectual Property Office in Korean Application No. 10-2017-7002772.
Communication dated Oct. 17, 2022 issued by the National Intellectual Property Administration of P.R. China in Chinese Application No. 201911105213.X.
Communication dated Jan. 3, 2023 issued by Intellectual Property India in Indian Patent Application No. 202028056630.
Notice of Allowance dated Nov. 16, 2022 issued by the United States Patent and Trademark Office in U.S. Appl. No. 17/030,466.
Communication dated Feb. 6, 2023, issued by the Korean Intellectual Property Office in Korean English Patent Application No. 10-2017-7002772.
Communication dated Feb. 28, 2023, issued by the National Intellectual Property Administration of PR China in Chinese Application No. 201911105859.8.
Chen Liang et al., "Low-complexity High Quality Full-band Audio Codec: ITU-T G.719," Journal of Military Communications Technology, vol. 32, No. 4, Dec. 2011, Total 5 pages.
Vaclav Eksler et al., "Coding of Unquantized Spectrum Sub-Bands in Superwideband Audio Codecs," IEEE, ICASSP 2011, pp. 5228-5231, May 2011.

* cited by examiner

SIGNAL ENCODING METHOD AND DEVICE AND SIGNAL DECODING METHOD AND DEVICE

CROSS-REFERENCE TO RELATED APPLICATIONS

This application is a Continuation application of U.S. application Ser. No. 16/282,677, filed on Feb. 22, 2019, which is a Continuation application of U.S. application Ser. No. 15/022,406, filed on Mar. 16, 2016, which is a National Stage of International Application No. PCT/KR2014/008627, filed on Sep. 16, 2014, which claims the benefit of U.S. Provisional Application No. 61/878,172, filed on Sep. 16, 2013, in the US Patent Office, the disclosures of which are incorporated herein in their entireties by reference.

TECHNICAL FIELD

One or more exemplary embodiments relate to encoding and decoding of an audio or speech signal, and more particularly, to a method and apparatus for encoding and decoding a spectral coefficient in a frequency domain.

BACKGROUND ART

Quantizers based on various schemes have been proposed for efficiently encoding spectral coefficients in a frequency domain. For example, a quantizer based on trellis coded quantization (TCQ), uniform scalar quantization (USQ), factorial pulse coding (FPC), algebraic vector quantization (AVQ), and pyramid vector quantization (PVQ), etc. has been used. Accordingly, a lossless encoder optimized for each quantizer has been also implemented.

DISCLOSURE

Technical Problems

One or more exemplary embodiments include a method and apparatus for adaptively encoding or decoding a spectral coefficient for various bit rates or various sizes of sub-bands in a frequency domain.

One or more exemplary embodiments include a non-transitory computer-readable recording medium storing a program for executing a signal encoding method or a signal decoding method.

One or more exemplary embodiments include a multimedia apparatus using a signal encoding method or a signal decoding method.

Technical Solution

According to one or more exemplary embodiments, a signal encoding method includes: selecting a important spectral component in band units for a normalized spectrum; and encoding information of the selected important spectral component based on a number, a position, a magnitude, and a sign thereof, in band units.

According to one or more exemplary embodiments, a signal decoding method includes: obtaining from a bitstream, information of a important spectral component of an encoded spectrum in band units; and decoding the obtained information of the important spectral component, based on a number, a position, a magnitude, and a sign thereof in band units.

Advantageous Effects

According to the one or more of the above exemplary embodiments, a spectral coefficient is encoded and decoded adaptively for various bit rates or various sizes of sub-bands.

MODE FOR INVENTION

Figure 1A:
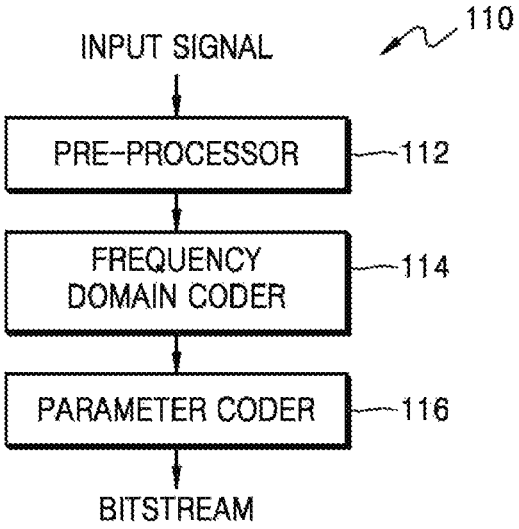
FIGS. 1A and 1B are block diagrams of an audio encoding apparatus and an audio decoding apparatus according to an exemplary embodiment, respectively.

Since the inventive concept may have diverse modified embodiments, preferred embodiments are illustrated in the drawings and are described in the detailed description of the inventive concept. However, this does not limit the inventive concept within specific embodiments and it should be understood that the inventive concept covers all the modifications, equivalents, and replacements within the idea and technical scope of the inventive concept. Moreover, detailed descriptions related to well-known functions or configurations will be ruled out in order not to unnecessarily obscure subject matters of the inventive concept.

It will be understood that although the terms of first and second are used herein to describe various elements, these elements should not be limited by these terms. Terms are only used to distinguish one component from other components.

In the following description, the technical terms are used only for explain a specific exemplary embodiment while not limiting the inventive concept. Terms used in the inventive concept have been selected as general terms which are widely used at present, in consideration of the functions of the inventive concept, but may be altered according to the intent of an operator of ordinary skill in the art, conventional practice, or introduction of new technology. Also, if there is a term which is arbitrarily selected by the applicant in a specific case, in which case a meaning of the term will be described in detail in a corresponding description portion of the inventive concept. Therefore, the terms should be defined on the basis of the entire content of this specification instead of a simple name of each of the terms.

The terms of a singular form may include plural forms unless referred to the contrary. The meaning of 'comprise', 'include', or 'have' specifies a property, a region, a fixed number, a step, a process, an element and/or a component but does not exclude other properties, regions, fixed numbers, steps, processes, elements and/or components.

Hereinafter, exemplary embodiments will be described in detail with reference to the accompanying drawings. Like numbers refer to like elements throughout the description of the figures, and a repetitive description on the same element is not provided.

Figure 1B:
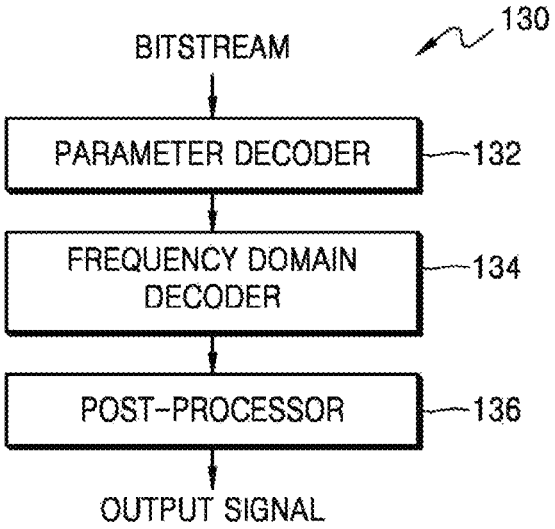

FIGS. 1A and 1B are block diagrams of an audio encoding apparatus and an audio decoding apparatus according to an exemplary embodiment, respectively.

The audio encoding apparatus 110 shown in FIG. 1A may include a pre-processor 112, a frequency domain coder 114, and a parameter coder 116. The components may be integrated in at least one module and may be implemented as at least one processor (not shown).

In FIG. 1A, the pre-processor 112 may perform filtering, down-sampling, or the like for an input signal, but is not limited thereto. The input signal may include a speech signal, a music signal, or a mixed signal of speech and music. Hereinafter, for convenience of explanation, the input signal is referred to as an audio signal.

The frequency domain coder 114 may perform a time-frequency transform on the audio signal provided by the pre-processor 112, select a coding tool in correspondence with the number of channels, a coding band, and a bit rate of the audio signal, and encode the audio signal by using the selected coding tool. The time-frequency transform may use a modified discrete cosine transform (MDCT), a modulated lapped transform (MLT), or a fast Fourier transform (FFT), but is not limited thereto. When the number of given bits is sufficient, a general transform coding scheme may be applied to the whole bands, and when the number of given bits is not sufficient, a bandwidth extension scheme may be applied to partial bands. When the audio signal is a stereo-channel or multi-channel, if the number of given bits is sufficient, encoding is performed for each channel, and if the number of given bits is not sufficient, a down-mixing scheme may be applied. An encoded spectral coefficient is generated by the frequency domain coder 114.

The parameter coder 116 may extract a parameter from the encoded spectral coefficient provided from the frequency domain coder 114 and encode the extracted parameter. The parameter may be extracted, for example, for each sub-band, which is a unit of grouping spectral coefficients, and may have a uniform or non-uniform length by reflecting a critical band. When each sub-band has a non-uniform length, a sub-band existing in a low frequency band may have a relatively short length compared with a sub-band existing in a high frequency band. The number and a length of sub-bands included in one frame vary according to codec algorithms and may affect the encoding performance. The parameter may include, for example a scale factor, power, average energy, or Norm, but is not limited thereto. Spectral coefficients and parameters obtained as an encoding result form a bitstream, and the bitstream may be stored in a storage medium or may be transmitted in a form of, for example, packets through a channel.

The audio decoding apparatus 130 shown in FIG. 1B may include a parameter decoder 132, a frequency domain decoder 134, and a post-processor 136. The frequency domain decoder 134 may include a frame error concealment algorithm or a packet loss concealment algorithm. The components may be integrated in at least one module and may be implemented as at least one processor (not shown).

In FIG. 1B, the parameter decoder 132 may decode parameters from a received bitstream and check whether an error such as erasure or loss has occurred in frame units from the decoded parameters. Various well-known methods may be used for the error check, and information on whether a current frame is a good frame or an erasure or loss frame is provided to the frequency domain decoder 134. Hereinafter, for convenience of explanation, the erasure or loss frame is referred to as an error frame.

When the current frame is a good frame, the frequency domain decoder 134 may generate synthesized spectral coefficients by performing decoding through a general transform decoding process. When the current frame is an error frame, the frequency domain decoder 134 may generate synthesized spectral coefficients by repeating spectral coefficients of a previous good frame (PGF) onto the error frame or by scaling the spectral coefficients of the PGF by a regression analysis to then be repeated onto the error frame, through a frame error concealment algorithm or a packet loss concealment algorithm. The frequency domain decoder 134 may generate a time domain signal by performing a frequency-time transform on the synthesized spectral coefficients.

The post-processor 136 may perform filtering, up-sampling, or the like for sound quality improvement with respect to the time domain signal provided from the frequency domain decoder 134, but is not limited thereto. The post-processor 136 provides a reconstructed audio signal as an output signal.

Figure 2A:
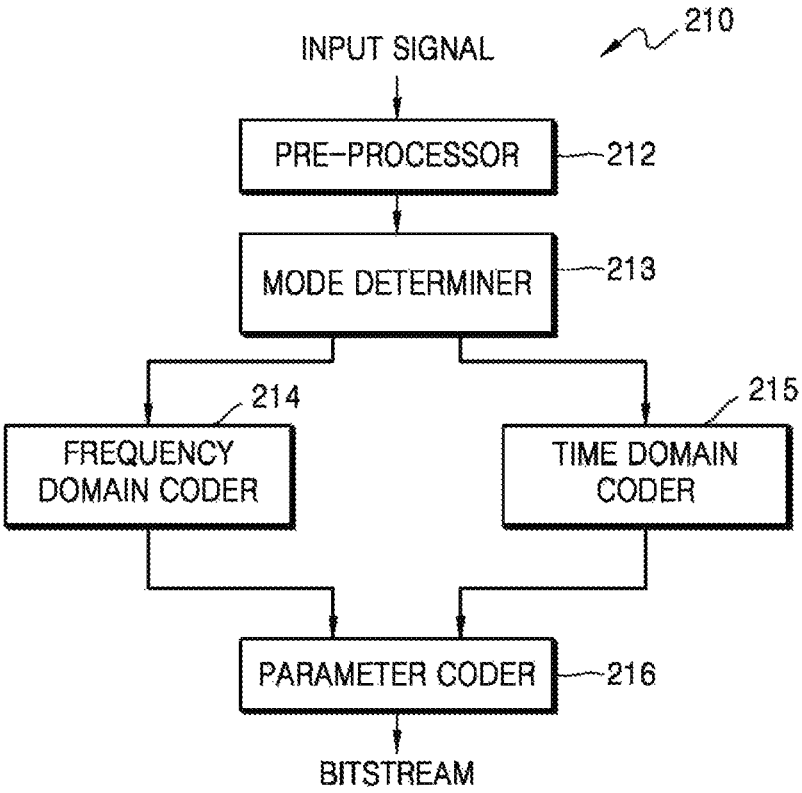
FIGS. 2A and 2B are block diagrams of an audio encoding apparatus and an audio decoding apparatus according to another exemplary embodiment, respectively.
Figure 2B:
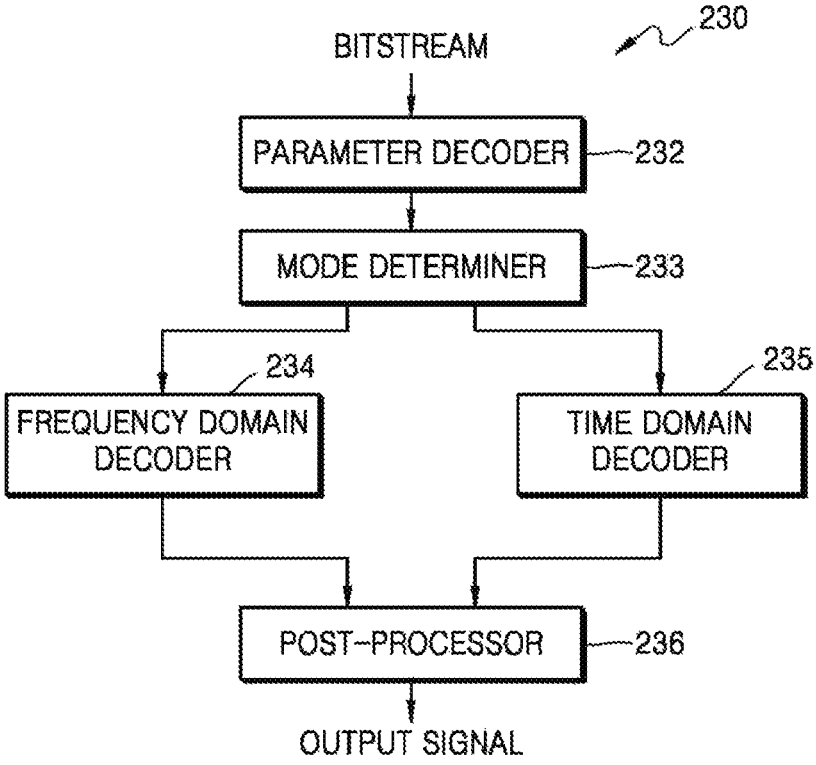

FIGS. 2A and 2B are block diagrams of an audio encoding apparatus and an audio decoding apparatus, according to another exemplary embodiment, respectively, which have a switching structure.

The audio encoding apparatus 210 shown in FIG. 2A may include a pre-processor unit 212, a mode determiner 213, a frequency domain coder 214, a time domain coder 215, and a parameter coder 216. The components may be integrated in at least one module and may be implemented as at least one processor (not shown).

In FIG. 2A, since the pre-processor 212 is substantially the same as the pre-processor 112 of FIG. 1A, the description thereof is not repeated.

The mode determiner 213 may determine a coding mode by referring to a characteristic of an input signal. The mode determiner 213 may determine according to the characteristic of the input signal whether a coding mode suitable for a current frame is a speech mode or a music mode and may also determine whether a coding mode efficient for the current frame is a time domain mode or a frequency domain mode. The characteristic of the input signal may be perceived by using a short-term characteristic of a frame or a long-term characteristic of a plurality of frames, but is not limited thereto. For example, if the input signal corresponds to a speech signal, the coding mode may be determined as the speech mode or the time domain mode, and if the input signal corresponds to a signal other than a speech signal, i.e., a music signal or a mixed signal, the coding mode may be determined as the music mode or the frequency domain mode. The mode determiner 213 may provide an output signal of the pre-processor 212 to the frequency domain coder 214 when the characteristic of the input signal corresponds to the music mode or the frequency domain mode and may provide an output signal of the pre-processor 212 to the time domain coder 215 when the characteristic of the input signal corresponds to the speech mode or the time domain mode.

Since the frequency domain coder 214 is substantially the same as the frequency domain coder 114 of FIG. 1A, the description thereof is not repeated.

The time domain coder 215 may perform code excited linear prediction (CELP) coding for an audio signal provided from the pre-processor 212. In detail, algebraic CELP may be used for the CELP coding, but the CELP coding is not limited thereto. An encoded spectral coefficient is generated by the time domain coder 215.

The parameter coder 216 may extract a parameter from the encoded spectral coefficient provided from the frequency domain coder 214 or the time domain coder 215 and encodes the extracted parameter. Since the parameter coder 216 is substantially the same as the parameter coder 116 of FIG. 1A, the description thereof is not repeated. Spectral coefficients and parameters obtained as an encoding result may form a bitstream together with coding mode information, and the bitstream may be transmitted in a form of packets through a channel or may be stored in a storage medium.

The audio decoding apparatus 230 shown in FIG. 2B may include a parameter decoder 232, a mode determiner 233, a frequency domain decoder 234, a time domain decoder 235, and a post-processor 236. Each of the frequency domain decoder 234 and the time domain decoder 235 may include a frame error concealment algorithm or a packet loss concealment algorithm in each corresponding domain. The components may be integrated in at least one module and may be implemented as at least one processor (not shown).

In FIG. 2B, the parameter decoder 232 may decode parameters from a bitstream transmitted in a form of packets and check whether an error has occurred in frame units from the decoded parameters. Various well-known methods may be used for the error check, and information on whether a current frame is a good frame or an error frame is provided to the frequency domain decoder 234 or the time domain decoder 235.

The mode determiner 233 may check coding mode information included in the bitstream and provide a current frame to the frequency domain decoder 234 or the time domain decoder 235.

The frequency domain decoder 234 may operate when a coding mode is the music mode or the frequency domain mode and generate synthesized spectral coefficients by performing decoding through a general transform decoding process when the current frame is a good frame. When the current frame is an error frame, and a coding mode of a previous frame is the music mode or the frequency domain mode, the frequency domain decoder 234 may generate synthesized spectral coefficients by repeating spectral coefficients of a previous good frame (PGF) onto the error frame or by scaling the spectral coefficients of the PGF by a regression analysis to then be repeated onto the error frame, through a frame error concealment algorithm or a packet loss concealment algorithm. The frequency domain decoder 234 may generate a time domain signal by performing a frequency-time transform on the synthesized spectral coefficients.

The time domain decoder 235 may operate when the coding mode is the speech mode or the time domain mode and generate a time domain signal by performing decoding through a general CELP decoding process when the current frame is a normal frame. When the current frame is an error frame, and the coding mode of the previous frame is the speech mode or the time domain mode, the time domain decoder 235 may perform a frame error concealment algorithm or a packet loss concealment algorithm in the time domain.

The post-processor 236 may perform filtering, up-sampling, or the like for the time domain signal provided from the frequency domain decoder 234 or the time domain decoder 235, but is not limited thereto. The post-processor 236 provides a reconstructed audio signal as an output signal.

Figure 3A:
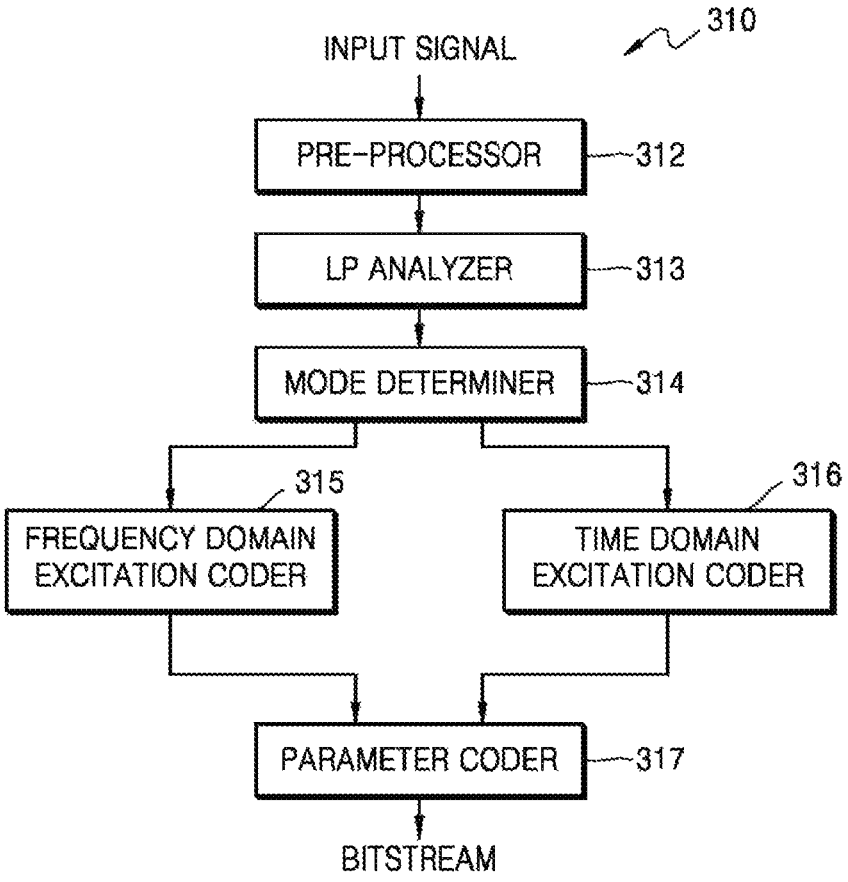
FIGS. 3A and 3B are block diagrams of an audio encoding apparatus and an audio decoding apparatus according to another exemplary embodiment, respectively.
Figure 3B:
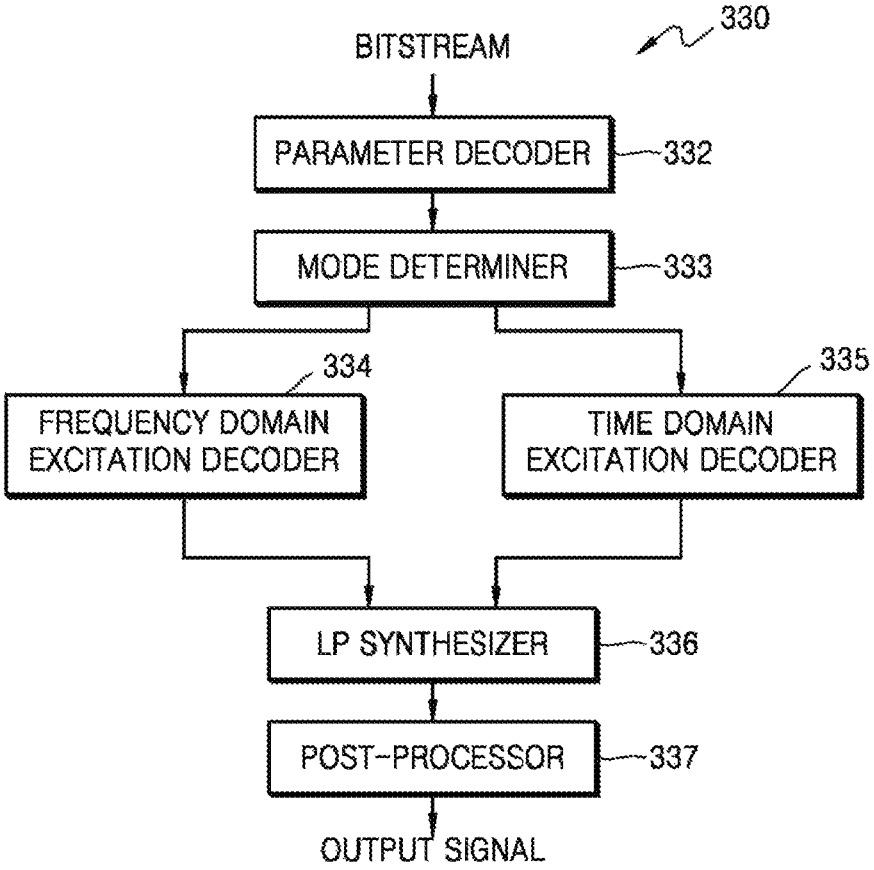

FIGS. 3A and 3B are block diagrams of an audio encoding apparatus and an audio decoding apparatus according to another exemplary embodiment, respectively.

The audio encoding apparatus 310 shown in FIG. 3A may include a pre-processor 312, a linear prediction (LP) analyzer 313, a mode determiner 314, a frequency domain excitation coder 315, a time domain excitation coder 316, and a parameter coder 317. The components may be integrated in at least one module and may be implemented as at least one processor (not shown).

In FIG. 3A, since the pre-processor 312 is substantially the same as the pre-processor 112 of FIG. 1A, the description thereof is not repeated.

The LP analyzer 313 may extract LP coefficients by performing LP analysis for an input signal and generate an excitation signal from the extracted LP coefficients. The excitation signal may be provided to one of the frequency domain excitation coder unit 315 and the time domain excitation coder 316 according to a coding mode.

Since the mode determiner 314 is substantially the same as the mode determiner 213 of FIG. 2A, the description thereof is not repeated.

The frequency domain excitation coder 315 may operate when the coding mode is the music mode or the frequency domain mode, and since the frequency domain excitation coder 315 is substantially the same as the frequency domain coder 114 of FIG. 1A except that an input signal is an excitation signal, the description thereof is not repeated.

The time domain excitation coder 316 may operate when the coding mode is the speech mode or the time domain mode, and since the time domain excitation coder unit 316 is substantially the same as the time domain coder 215 of FIG. 2A, the description thereof is not repeated.

The parameter coder 317 may extract a parameter from an encoded spectral coefficient provided from the frequency domain excitation coder 315 or the time domain excitation coder 316 and encode the extracted parameter. Since the parameter coder 317 is substantially the same as the parameter coder 116 of FIG. 1A, the description thereof is not repeated. Spectral coefficients and parameters obtained as an encoding result may form a bitstream together with coding mode information, and the bitstream may be transmitted in a form of packets through a channel or may be stored in a storage medium.

The audio decoding apparatus 330 shown in FIG. 3B may include a parameter decoder 332, a mode determiner 333, a frequency domain excitation decoder 334, a time domain excitation decoder 335, an LP synthesizer 336, and a post-processor 337. Each of the frequency domain excitation decoder 334 and the time domain excitation decoder 335 may include a frame error concealment algorithm or a packet loss concealment algorithm in each corresponding domain. The components may be integrated in at least one module and may be implemented as at least one processor (not shown).

In FIG. 3B, the parameter decoder 332 may decode parameters from a bitstream transmitted in a form of packets and check whether an error has occurred in frame units from the decoded parameters. Various well-known methods may be used for the error check, and information on whether a current frame is a good frame or an error frame is provided to the frequency domain excitation decoder 334 or the time domain excitation decoder 335.

The mode determiner 333 may check coding mode information included in the bitstream and provide a current frame to the frequency domain excitation decoder 334 or the time domain excitation decoder 335.

The frequency domain excitation decoder 334 may operate when a coding mode is the music mode or the frequency domain mode and generate synthesized spectral coefficients by performing decoding through a general transform decoding process when the current frame is a good frame. When the current frame is an error frame, and a coding mode of a previous frame is the music mode or the frequency domain mode, the frequency domain excitation decoder 334 may generate synthesized spectral coefficients by repeating spectral coefficients of a previous good frame (PGF) onto the error frame or by scaling the spectral coefficients of the PGF by a regression analysis to then be repeated onto the error frame, through a frame error concealment algorithm or a packet loss concealment algorithm. The frequency domain excitation decoder 334 may generate an excitation signal that is a time domain signal by performing a frequency-time transform on the synthesized spectral coefficients.

The time domain excitation decoder 335 may operate when the coding mode is the speech mode or the time domain mode and generate an excitation signal that is a time domain signal by performing decoding through a general CELP decoding process when the current frame is a good frame. When the current frame is an error frame, and the coding mode of the previous frame is the speech mode or the time domain mode, the time domain excitation decoder 335 may perform a frame error concealment algorithm or a packet loss concealment algorithm in the time domain.

The LP synthesizer 336 may generate a time domain signal by performing LP synthesis for the excitation signal provided from the frequency domain excitation decoder 334 or the time domain excitation decoder 335.

The post-processor 337 may perform filtering, up-sampling, or the like for the time domain signal provided from the LP synthesizer 336, but is not limited thereto. The post-processor 337 provides a reconstructed audio signal as an output signal.

Figure 4A:
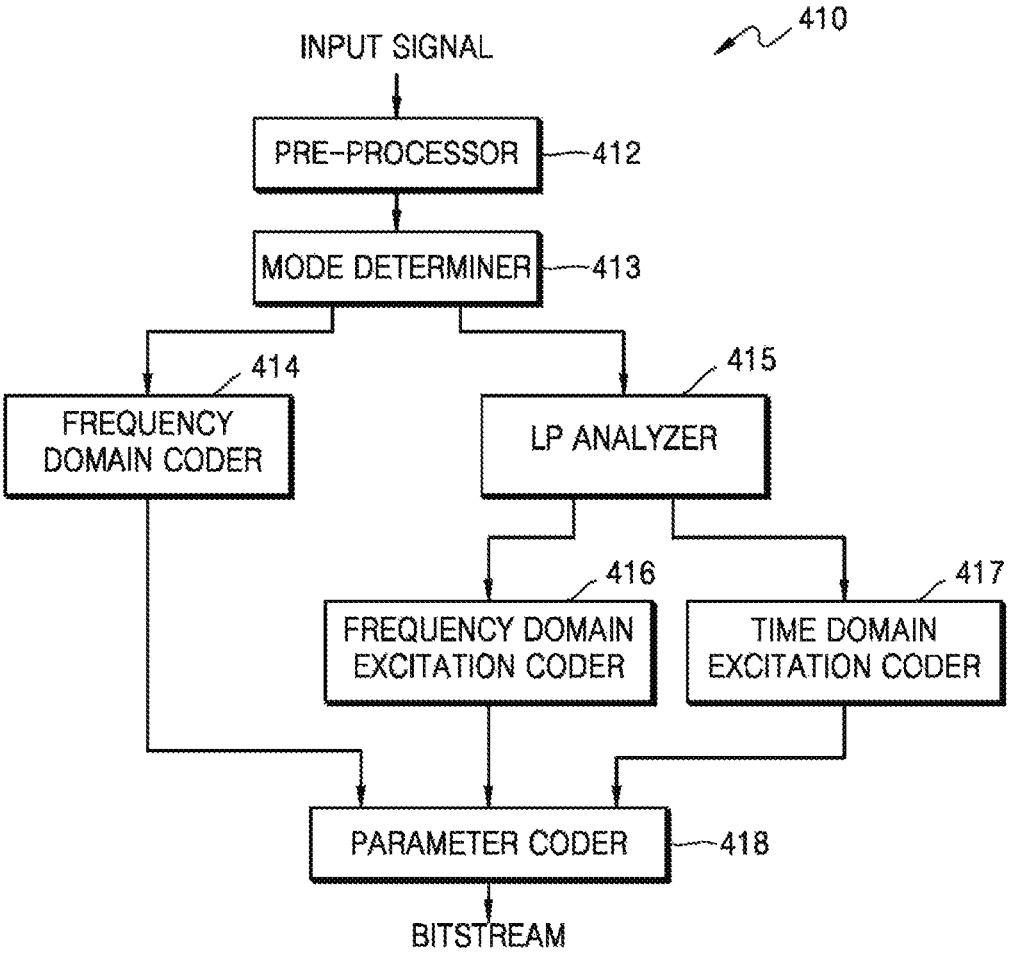
FIGS. 4A and 4B are block diagrams of an audio encoding apparatus and an audio decoding apparatus according to another exemplary embodiment, respectively.
Figure 4B:
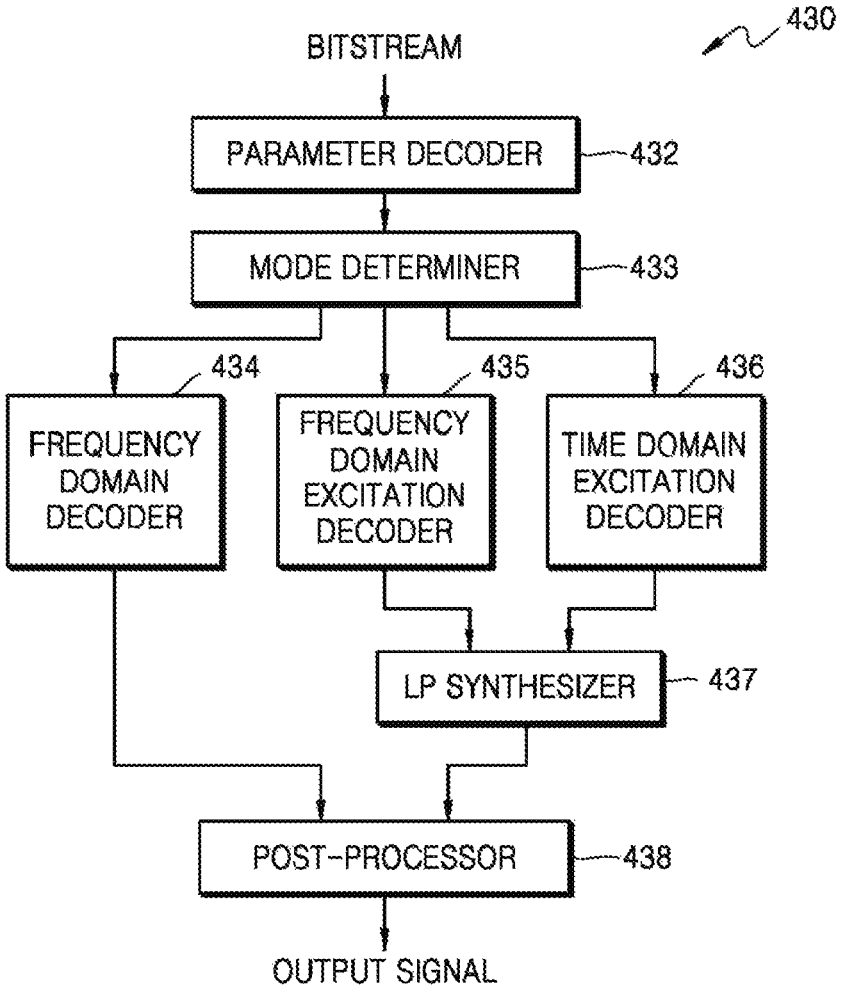

FIGS. 4A and 4B are block diagrams of an audio encoding apparatus and an audio decoding apparatus according to another exemplary embodiment, respectively, which have a switching structure.

The audio encoding apparatus 410 shown in FIG. 4A may include a pre-processor 412, a mode determiner 413, a frequency domain coder 414, an LP analyzer 415, a frequency domain excitation coder 416, a time domain excitation coder 417, and a parameter coder 418. The components may be integrated in at least one module and may be implemented as at least one processor (not shown). Since it can be considered that the audio encoding apparatus 410 shown in FIG. 4A is obtained by combining the audio encoding apparatus 210 of FIG. 2A and the audio encoding apparatus 310 of FIG. 3A, the description of operations of common parts is not repeated, and an operation of the mode determination unit 413 will now be described.

The mode determiner 413 may determine a coding mode of an input signal by referring to a characteristic and a bit rate of the input signal. The mode determiner 413 may determine the coding mode as a CELP mode or another mode based on whether a current frame is the speech mode or the music mode according to the characteristic of the input signal and based on whether a coding mode efficient for the current frame is the time domain mode or the frequency domain mode. The mode determiner 413 may determine the coding mode as the CELP mode when the characteristic of the input signal corresponds to the speech mode, determine the coding mode as the frequency domain mode when the characteristic of the input signal corresponds to the music mode and a high bit rate, and determine the coding mode as an audio mode when the characteristic of the input signal corresponds to the music mode and a low bit rate. The mode determiner 413 may provide the input signal to the frequency domain coder 414 when the coding mode is the frequency domain mode, provide the input signal to the frequency domain excitation coder 416 via the LP analyzer 415 when the coding mode is the audio mode, and provide the input signal to the time domain excitation coder 417 via the LP analyzer 415 when the coding mode is the CELP mode.

The frequency domain coder 414 may correspond to the frequency domain coder 114 in the audio encoding apparatus 110 of FIG. 1A or the frequency domain coder 214 in the audio encoding apparatus 210 of FIG. 2A, and the frequency domain excitation coder 416 or the time domain excitation coder 417 may correspond to the frequency domain excitation coder 315 or the time domain excitation coder 316 in the audio encoding apparatus 310 of FIG. 3A.

The audio decoding apparatus 430 shown in FIG. 4B may include a parameter decoder 432, a mode determiner 433, a frequency domain decoder 434, a frequency domain excitation decoder 435, a time domain excitation decoder 436, an LP synthesizer 437, and a post-processor 438. Each of the frequency domain decoder 434, the frequency domain excitation decoder 435, and the time domain excitation decoder 436 may include a frame error concealment algorithm or a packet loss concealment algorithm in each corresponding domain. The components may be integrated in at least one module and may be implemented as at least one processor (not shown). Since it can be considered that the audio decoding apparatus 430 shown in FIG. 4B is obtained by combining the audio decoding apparatus 230 of FIG. 2B and the audio decoding apparatus 330 of FIG. 3B, the description of operations of common parts is not repeated, and an operation of the mode determiner 433 will now be described.

The mode determiner 433 may check coding mode information included in a bitstream and provide a current frame to the frequency domain decoder 434, the frequency domain excitation decoder 435, or the time domain excitation decoder 436.

The frequency domain decoder 434 may correspond to the frequency domain decoder 134 in the audio decoding apparatus 130 of FIG. 1B or the frequency domain decoder 234 in the audio encoding apparatus 230 of FIG. 2B, and the frequency domain excitation decoder 435 or the time domain excitation decoder 436 may correspond to the frequency domain excitation decoder 334 or the time domain excitation decoder 335 in the audio decoding apparatus 330 of FIG. 3B.

Figure 5:
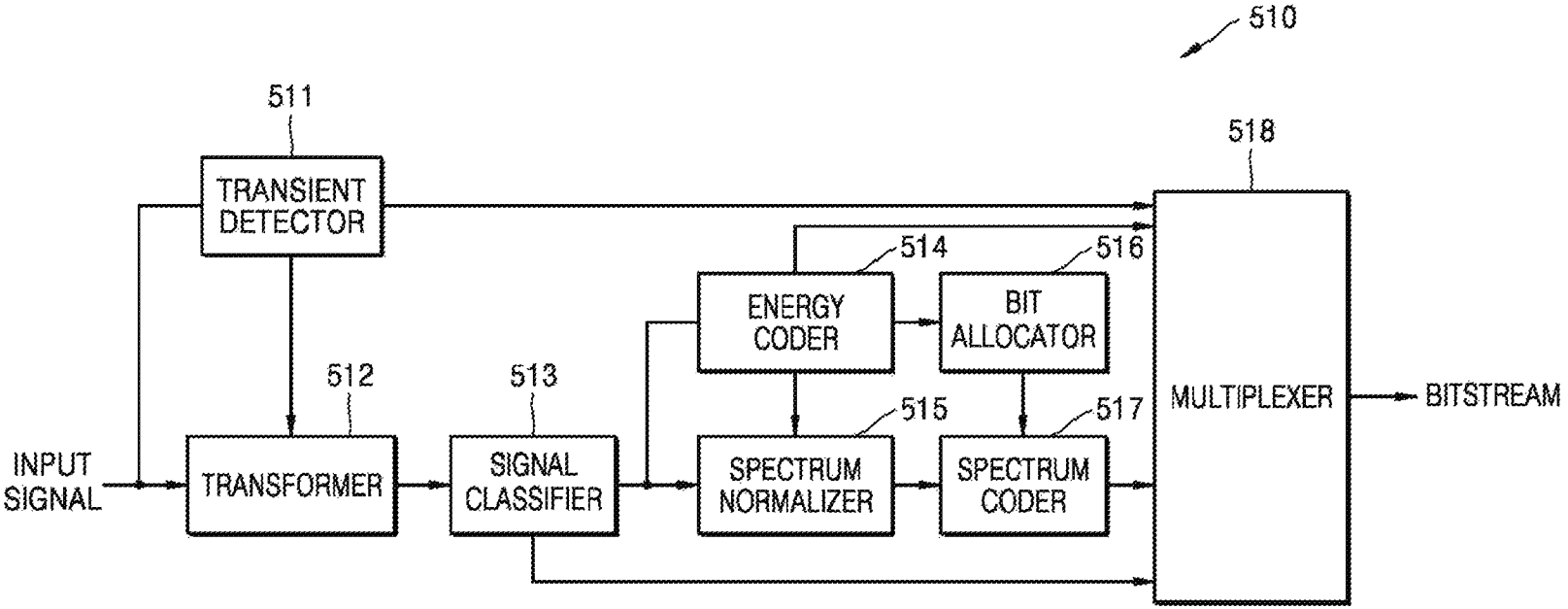
FIG. 5 is a block diagram of a frequency domain audio encoding apparatus according to an exemplary embodiment.

FIG. 5 is a block diagram of a frequency domain audio encoding apparatus according to an exemplary embodiment.

The frequency domain audio encoding apparatus 510 shown in FIG. 5 may include a transient detector 511, a transformer 512, a signal classifier 513, an energy coder 514, a spectrum normalizer 515, a bit allocator 516, a spectrum coder 517, and a multiplexer 518. The components may be integrated in at least one module and may be implemented as at least one processor (not shown). The frequency domain audio encoding apparatus 510 may perform all functions of the frequency domain audio coder 214 and partial functions of the parameter coder 216 shown in FIG. 2. The frequency domain audio encoding apparatus 510 may be replaced by a configuration of an encoder disclosed in the ITU-T G.719 standard except for the signal classifier 513, and the transformer 512 may use a transform window having an overlap duration of 50%. In addition, the frequency domain audio encoding apparatus 510 may be replaced by a configuration of an encoder disclosed in the ITU-T G.719 standard except for the transient detector 511 and the signal classifier 513. In each case, although not shown, a noise level estimation unit may be further included at a rear end of the spectrum coder 517 as in the ITU-T G.719 standard to estimate a noise level for a spectral coefficient to which a bit is not allocated in a bit allocation process and insert the estimated noise level into a bitstream.

Referring to FIG. 5, the transient detector 511 may detect a duration exhibiting a transient characteristic by analyzing an input signal and generate transient signaling information for each frame in response to a result of the detection. Various well-known methods may be used for the detection of a transient duration. According to an exemplary embodiment, the transient detector 511 may primarily determine whether a current frame is a transient frame and secondarily verify the current frame that has been determined as a transient frame. The transient signaling information may be included in a bitstream by the multiplexer 518 and may be provided to the transformer 512.

The transformer 512 may determine a window size to be used for a transform according to a result of the detection of a transient duration and perform a time-frequency transform based on the determined window size. For example, a short window may be applied to a sub-band from which a transient duration has been detected, and a long window may be applied to a sub-band from which a transient duration has not been detected. As another example, a short window may be applied to a frame including a transient duration.

The signal classifier 513 may analyze a spectrum provided from the transformer 512 in frame units to determine whether each frame corresponds to a harmonic frame. Various well-known methods may be used for the determination of a harmonic frame. According to an exemplary embodiment, the signal classifier 513 may divide the spectrum provided from the transformer 512 into a plurality of sub-bands and obtain a peak energy value and an average energy value for each sub-band. Thereafter, the signal classifier 513 may obtain the number of sub-bands of which a peak energy value is greater than an average energy value by a predetermined ratio or above for each frame and determine, as a harmonic frame, a frame in which the obtained number of sub-bands is greater than or equal to a predetermined value. The predetermined ratio and the predetermined value may be determined in advance through experiments or simulations. Harmonic signaling information may be included in the bitstream by the multiplexer 518.

The energy coder 514 may obtain energy in each sub-band unit and quantize and lossless-encode the energy. According to an embodiment, a Norm value corresponding to average spectral energy in each sub-band unit may be used as the energy and a scale factor or a power may also be used, but the energy is not limited thereto. The Norm value of each sub-band may be provided to the spectrum normalizer 515 and the bit allocator 516 and may be included in the bitstream by the multiplexer 518.

The spectrum normalizer 515 may normalize the spectrum by using the Norm value obtained in each sub-band unit.

The bit allocator 516 may allocate bits in integer units or fraction units by using the Norm value obtained in each sub-band unit. In addition, the bit allocator 516 may calculate a masking threshold by using the Norm value obtained in each sub-band unit and estimate the perceptually required number of bits, i.e., the allowable number of bits, by using the masking threshold. The bit allocator 516 may limit that the allocated number of bits does not exceed the allowable number of bits for each sub-band. The bit allocator 516 may sequentially allocate bits from a sub-band having a larger Norm value and weigh the Norm value of each sub-band according to perceptual importance of each sub-band to adjust the allocated number of bits so that a more number of bits are allocated to a perceptually important sub-band. The quantized Norm value provided from the energy coder 514 to the bit allocator 516 may be used for the bit allocation after being adjusted in advance to consider psychoacoustic weighting and a masking effect as in the ITU-T G.719 standard.

The spectrum coder 517 may quantize the normalized spectrum by using the allocated number of bits of each sub-band and lossless-encode a result of the quantization. For example, TCQ, USQ, FPC, AVQ and PVQ or a combination thereof and a lossless encoder optimized for each quantizer may be used for the spectrum encoding. In addition, a trellis coding may also be used for the spectrum encoding, but the spectrum encoding is not limited thereto. Moreover, a variety of spectrum encoding methods may also be used according to either environments in which a corresponding codec is embodied or a user's need. Information on the spectrum encoded by the spectrum coder 517 may be included in the bitstream by the multiplexer 518.

Figure 6:
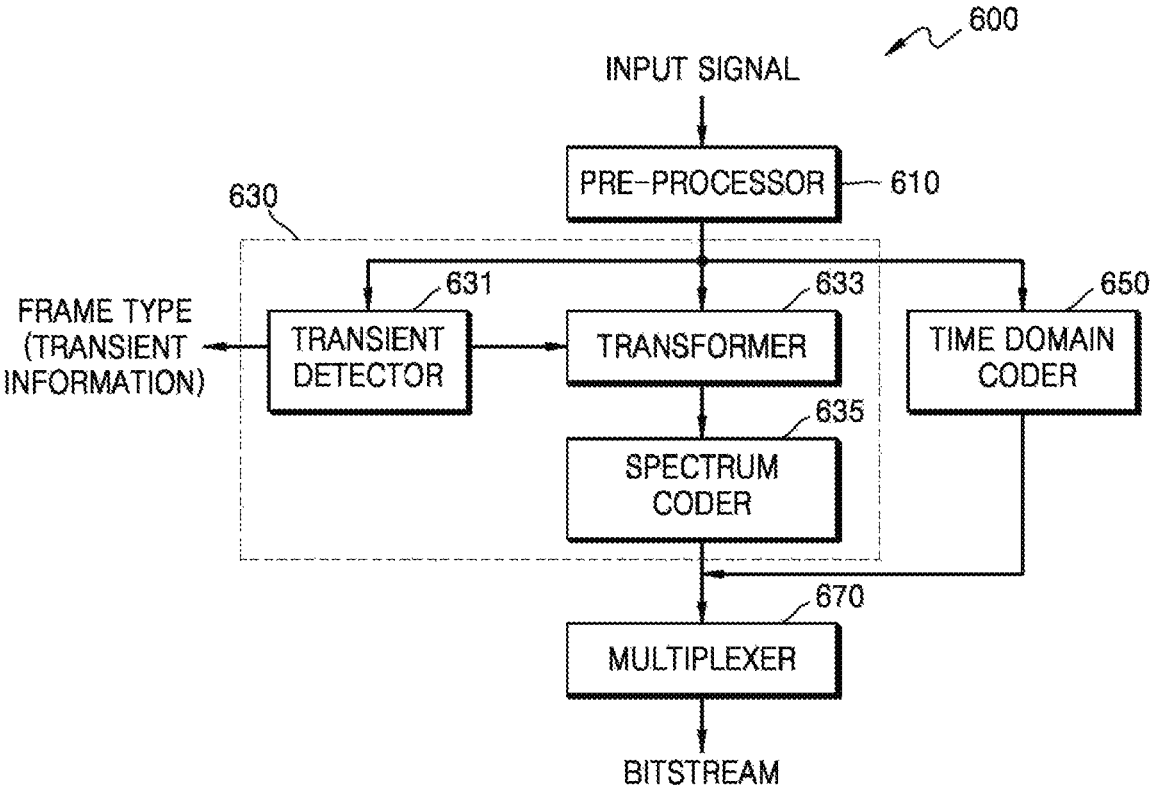
FIG. 6 is a block diagram of a frequency domain audio decoding apparatus according to an exemplary embodiment.

FIG. 6 is a block diagram of a frequency domain audio encoding apparatus according to an exemplary embodiment.

The frequency domain audio encoding apparatus 600 shown in FIG. 6 may include a pre-processor 610, a frequency domain coder 630, a time domain coder 650, and a multiplexer 670. The frequency domain coder 630 may include a transient detector 631, a transformer 633 and a spectrum coder 635. The components may be integrated in at least one module and may be implemented as at least one processor (not shown).

Referring to FIG. 6, the pre-processor 610 may perform filtering, down-sampling, or the like for an input signal, but is not limited thereto. The pre-processor 610 may determine a coding mode according to a signal characteristic. The pre-processor 610 may determine according to a signal characteristic whether a coding mode suitable for a current frame is a speech mode or a music mode and may also determine whether a coding mode efficient for the current frame is a time domain mode or a frequency domain mode. The signal characteristic may be perceived by using a short-term characteristic of a frame or a long-term characteristic of a plurality of frames, but is not limited thereto. For example, if the input signal corresponds to a speech signal, the coding mode may be determined as the speech mode or the time domain mode, and if the input signal corresponds to a signal other than a speech signal, i.e., a music signal or a mixed signal, the coding mode may be determined as the music mode or the frequency domain mode. The pre-processor 610 may provide an input signal to the frequency domain coder 630 when the signal characteristic corresponds to the music mode or the frequency domain mode and may provide an input signal to the time domain coder 660 when the signal characteristic corresponds to the speech mode or the time domain mode.

The frequency domain coder 630 may process an audio signal provided from the pre-processor 610 based on a transform coding scheme. In detail, the transient detector 631 may detect a transient component from the audio signal and determine whether a current frame corresponds to a transient frame. The transformer 633 may determine a length or a shape of a transform window based on a frame type, i.e. transient information provided from the transient detector 631 and may transform the audio signal into a frequency domain based on the determined transform window. As an example of a transform tool, a modified discrete cosine transform (MDCT), a fast Fourier transform (FFT) or a modulated lapped transform (MLT) may be used. In general, a short transform window may be applied to a frame including a transient component. The spectrum coder 635 may perform encoding on the audio spectrum transformed into the frequency domain. The spectrum coder 635 will be described below in more detail with reference to FIGS. 7 and 9.

The time domain coder 650 may perform code excited linear prediction (CELP) coding on an audio signal provided from the pre-processor 610. In detail, algebraic CELP may be used for the CELP coding, but the CELP coding is not limited thereto.

The multiplexer 670 may multiplex spectral components or signal components and variable indices generated as a result of encoding in the frequency domain coder 630 or the time domain coder 650 so as to generate a bitstream. The bitstream may be stored in a storage medium or may be transmitted in a form of packets through a channel.

Figure 7:
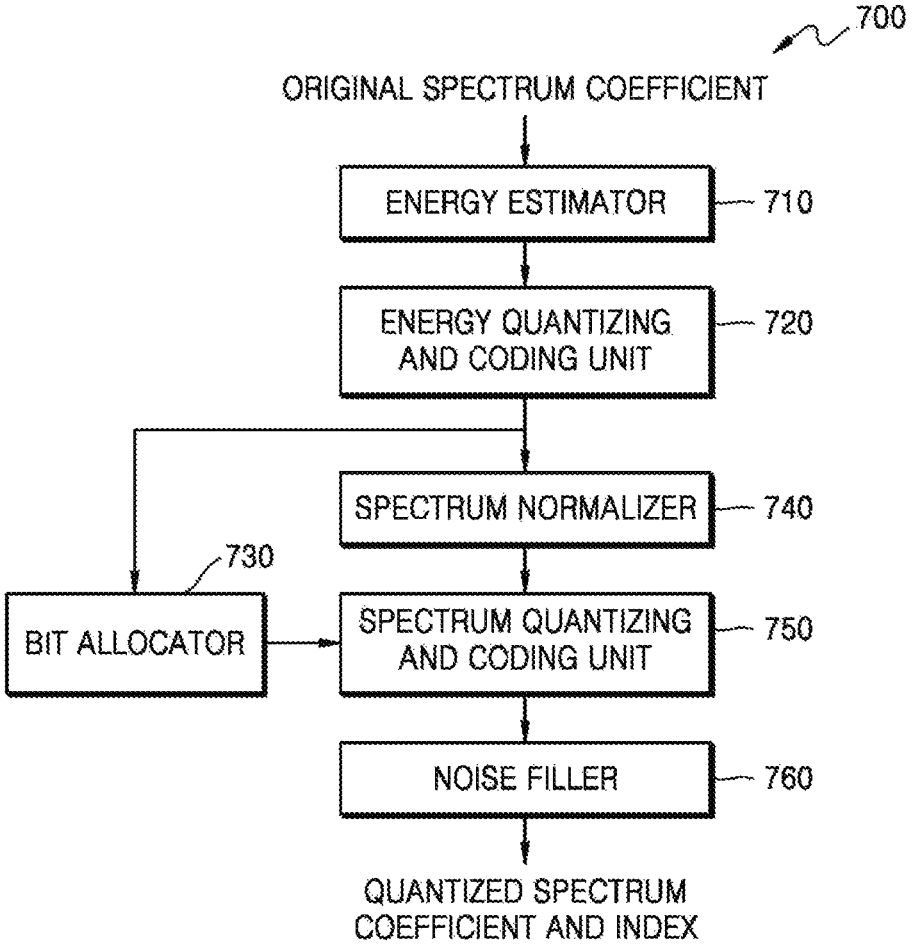
FIG. 7 is a block diagram of a spectrum encoding apparatus according to an exemplary embodiment.

FIG. 7 is a block diagram of a spectrum encoding apparatus according to an exemplary embodiment. The spectrum encoding apparatus shown in FIG. 7 may correspond to the spectrum coder 635 of FIG. 6, may be included in another frequency domain encoding apparatus, or may be implemented independently.

The spectrum encoding apparatus shown in FIG. 7 may include an energy estimator 710, an energy quantizing and coding unit 720, a bit allocator 730, a spectrum normalizer 740, a spectrum quantizing and coding unit 750 and a noise filler 760.

Referring to FIG. 7, the energy estimator 710 may divide original spectral coefficients into a plurality of sub-bands and estimate energy, for example, a Norm value for each sub-band. Each sub-band may have a uniform length in a frame. When each sub-band has a non-uniform length, the number of spectral coefficients included in a sub-band may be increased from a low frequency to a high frequency band.

The energy quantizing and coding unit 720 may quantize and encode an estimated Norm value for each sub-band. The Norm value may be quantized by means of variable tools such as vector quantization (VQ), scalar quantization (SQ), trellis coded quantization (TCQ), lattice vector quantization (LVQ), etc. The energy quantizing and coding unit 720 may additionally perform lossless coding for further increasing coding efficiency.

The bit allocator 730 may allocate bits required for coding in consideration of allowable bits of a frame, based on the quantized Norm value for each sub-band.

The spectrum normalizer 740 may normalize the spectrum based on the Norm value obtained for each sub-band.

The spectrum quantizing and coding unit 750 may quantize and encode the normalized spectrum based on allocated bits for each sub-band.

The noise filler 760 may add noises into a component quantized to zero due to constraints of allowable bits in the spectrum quantizing and coding unit 750.

Figure 8:
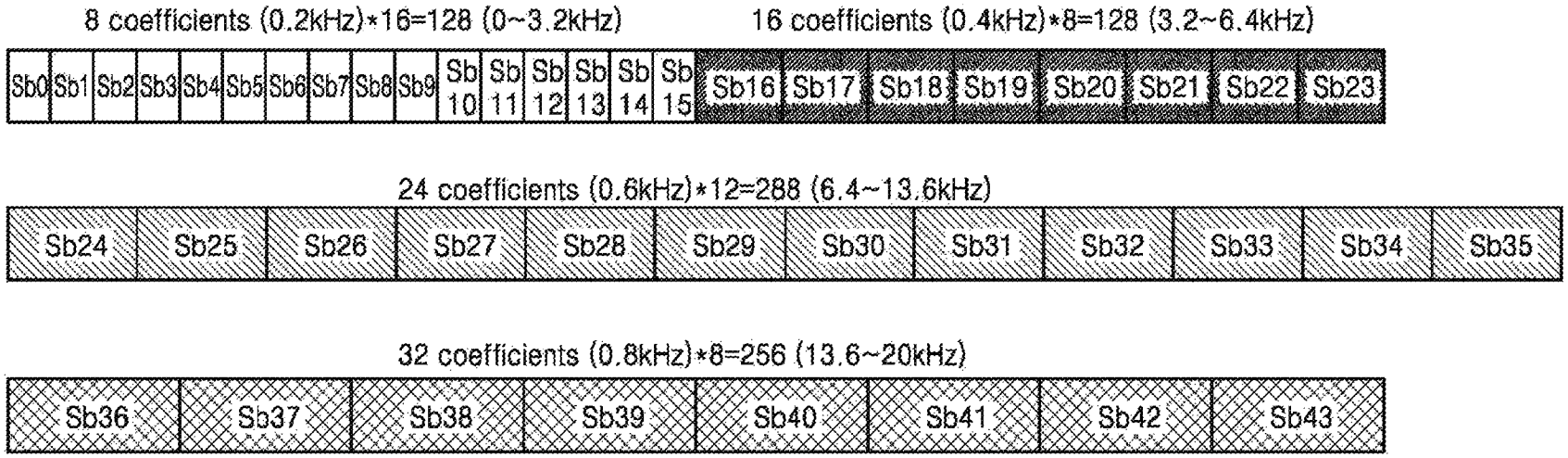
FIG. 8 shows an example of sub-band division.

FIG. 8 shows an example of sub-band division.

Referring to FIG. 8, when an input signal uses a sampling frequency of 48 KHz and has a frame length of 20 ms, the number of samples to be processed for each frame is 960. That is, when the input signal is transformed by using MDCT with 50% overlapping, 960 spectral coefficients are obtained. A ratio of overlapping may be variably set according a coding scheme. In a frequency domain, a band up to 24 KHz may be theoretically processed and a band up to 20 KHz may be represented in consideration of an audible range. In a low band of 0 to 3.2 KHz, a sub-band comprises 8 spectral coefficients. In a band of 3.2 to 6.4 KHz, a sub-band comprises 16 spectral coefficients. In a band of 6.4 to 13.6 KHz, a sub-band comprises 24 spectral coefficients. In a band of 13.6 to 20 KHz, a sub-band comprises 32 spectral coefficients. For a predetermined band set in an encoding apparatus, coding based on a Norm value may be performed and for a high band above the predetermined band, coding based on variable schemes such as band extension may be applied.

Figure 9:
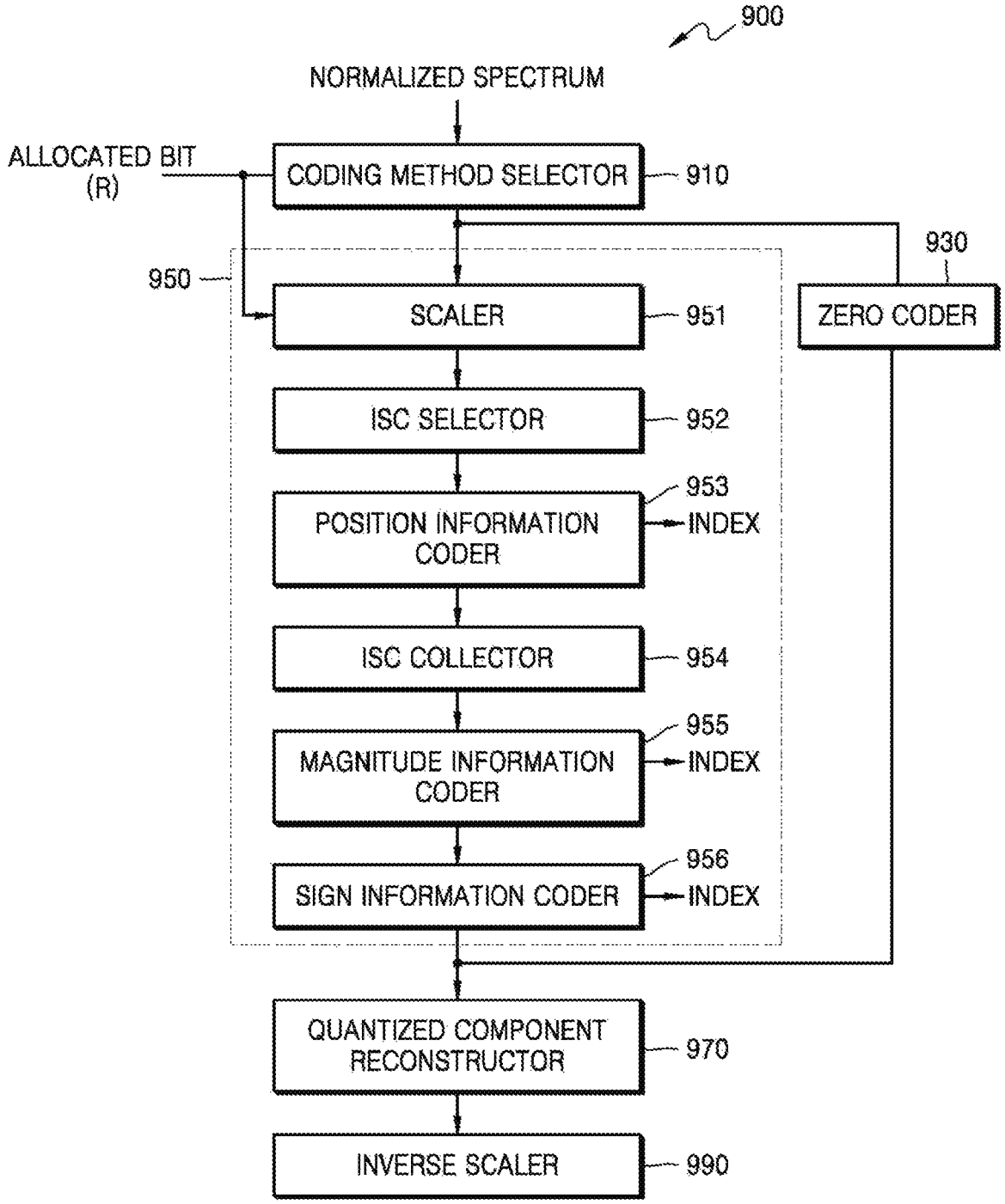
FIG. 9 is a block diagram of a spectrum quantizing and encoding apparatus according to an exemplary embodiment.

FIG. 9 is a block diagram of a spectrum quantizing and encoding apparatus 900 according to an exemplary embodiment. The spectrum quantizing and encoding apparatus 900 of FIG. 9 may correspond to the spectrum quantizing and coding unit 750 of FIG. 7, may be included in another frequency domain encoding apparatus, or may be implemented independently.

The spectrum quantizing and encoding apparatus 900 of FIG. 9 may include an coding method selector 910, a zero coder 930, a coefficient coder 950, a quantized component reconstructor 970, and an inverse scaler 990. The coefficient coder 950 may include a scaler 951, an important spectral component (ISC) selector 952, a position information coder 953, an ISC collector 954, a magnitude information coder 955, and a sign information coder 956.

Referring to FIG. 9, the coding method selector 910 may select a coding method, based on an allocated bit for each band. A normalized spectrum may be provided to the zero coder 930 or the coefficient coder 950, based on a coding method which is selected for each band.

The zero coder 930 may encode all samples into 0 for a band where an allocated bit is 0.

The coefficient coder 950 may perform encoding by using a quantizer which is selected for a band where an allocated bit is not 0. In detail, the coefficient coder 950 may select an important spectral component in band units for a normalized spectrum and encode information of the selected important spectral component for each band, based on a number, a position, a magnitude, and a sign. A magnitude of an important spectral component may be encoded by a scheme which differs from a scheme of encoding a number, a position, and a sign. For example, a magnitude of an important spectral component may be quantized and arithmetic-coded by using one selected from USQ and TCQ, and a number, a position, and a sign of the important spectral component may be coding by arithmetic coding. When it is determined that a specific band includes important information, the USQ may be used, and otherwise, the TCQ may be used. According to an exemplary embodiment, one of the TCQ and the USQ may be selected based on signal characteristic. Here, the signal characteristic may include a length of each band or a number of bits allocated to each band. For example, when an average number of bits allocated to each sample included in a band is equal to greater than a threshold value (for example, 0.75), a corresponding band may be determined as including very important information, and thus, the USQ may be used. Also, in a low band where a length of a band is short, the USQ may be used depending on the case.

The scaler 951 may perform scaling on a normalized spectrum based on a number of bits allocated to a band to control a bit rate. The scaler 951 may perform scaling by considering an average bit allocation for each spectral coefficient, namely each sample included in the band. For example, as the average bit allocation becomes larger, more scaling may be performed.

The ISC selector 952 may select an ISC from the scaled spectrum for controlling the bit rate, based on a predetermined reference. The ISC selector 953 may analyze a degree of scaling from the scaled spectrum and obtain an actual nonzero position. Here, the ISC may correspond to an actual nonzero spectral coefficient before scaling. The ISC selector 953 may select a spectral coefficient (i.e., a nonzero position), which is to be encoded, by taking into account a distribution and a variance of spectral coefficients, based on a bit allocation for each band. The TCQ may be used for selecting the ISC.

The position information coder 953 may encode position information of the ISC selected by the ISC selector 952, namely, position information of the nonzero spectral coefficient. The position information may include a number and a position of selected ISCs. The arithmetic encoding may be used for encoding the position information.

The ISC collector 954 may gather the selected ISCs to construct a new buffer. A zero band and an unselected spectrum may be excluded for colleting ISCs.

The magnitude information coder 955 may perform encoding on magnitude information of a newly constructed ISC. In this case, quantization may be performed by using one selected from the TCQ and the USQ, and the arithmetic coding may be additionally performed. In order to enhance an efficiency of the arithmetic coding, nonzero position information and the number of ISCs may be used for the arithmetic coding.

The sign information coder 956 may perform encoding on sign information of the selected ISC. The arithmetic coding may be used for encoding the sign information.

The quantized component reconstructor 970 may recover a real quantized component, based on information about a position, a magnitude, and a sign of an ISC. Here, 0 may be allocated to a zero position, namely, a spectral coefficient encoded into 0.

The inverse scaler 990 may perform inverse scaling on the reconstructed quantized component to output a quantized spectral coefficient having the same level as that of the normalized spectrum. The scaler 951 and the inverse scaler 990 may use the same scaling factor.

Figure 10:
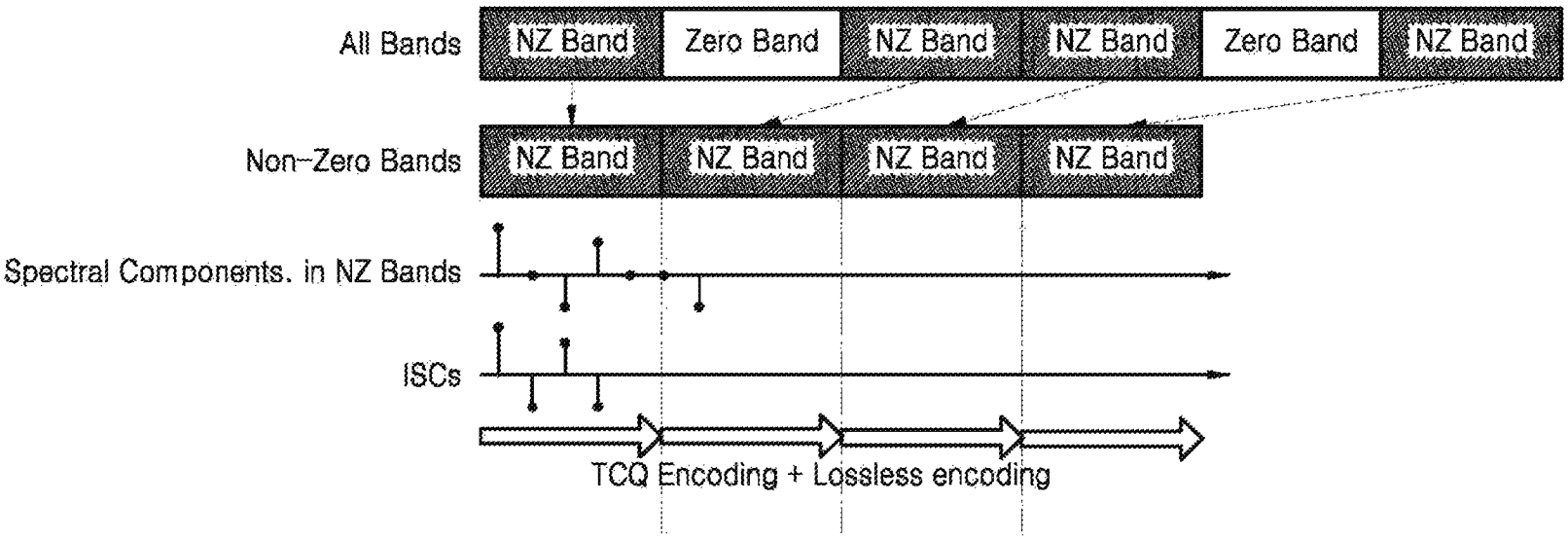
FIG. 10 is a diagram of an important spectral component (ISC) collecting operation.

FIG. 10 is a diagram illustrating an ISC gathering operation. First, a zero band, namely, a band which is to be quantized to 0, is excluded. Next, a new buffer may be constructed by using an ISC selected from among spectrum components which exist in a nonzero band. The USQ or the TCQ may be performed for a newly constructed ISC in band units, and lossless encoding corresponding thereto may be performed.

Figure 11:
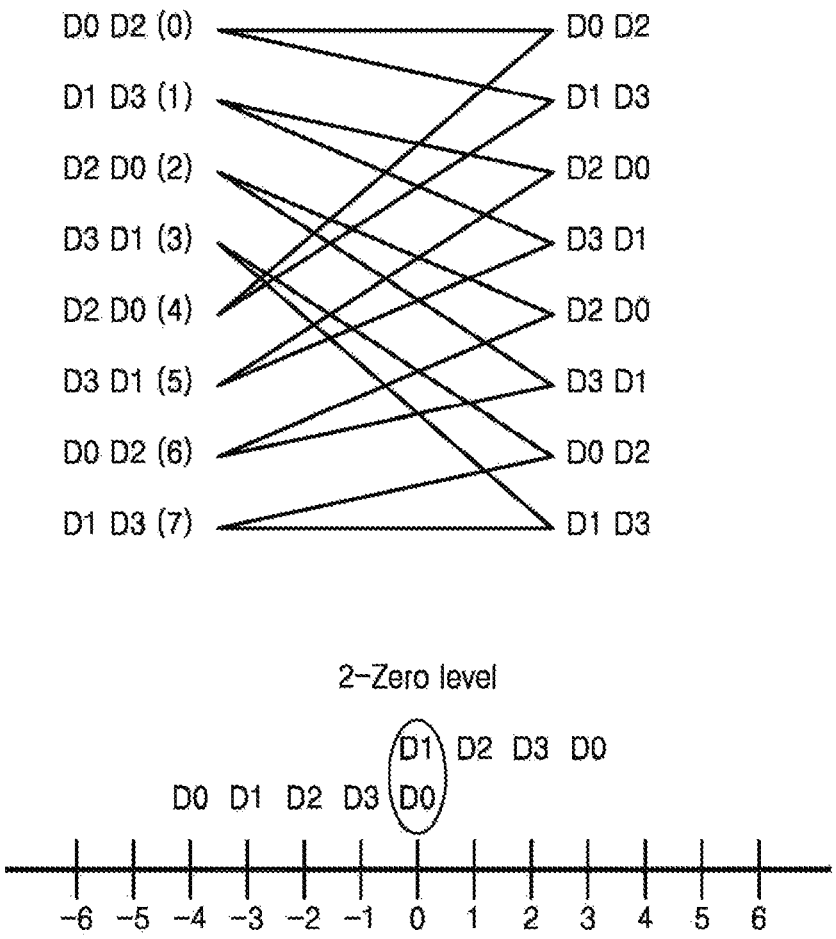
FIG. 11 shows an example of a TCQ applied to an exemplary embodiment.

FIG. 11 shows an example of a TCQ applied to an exemplary embodiment, and corresponds to an 8-state 4-coset trellis structure with 2-zero level. Detailed descriptions on the TCQ are disclosed in U.S. Pat. No. 7,605,727.

Figure 12:
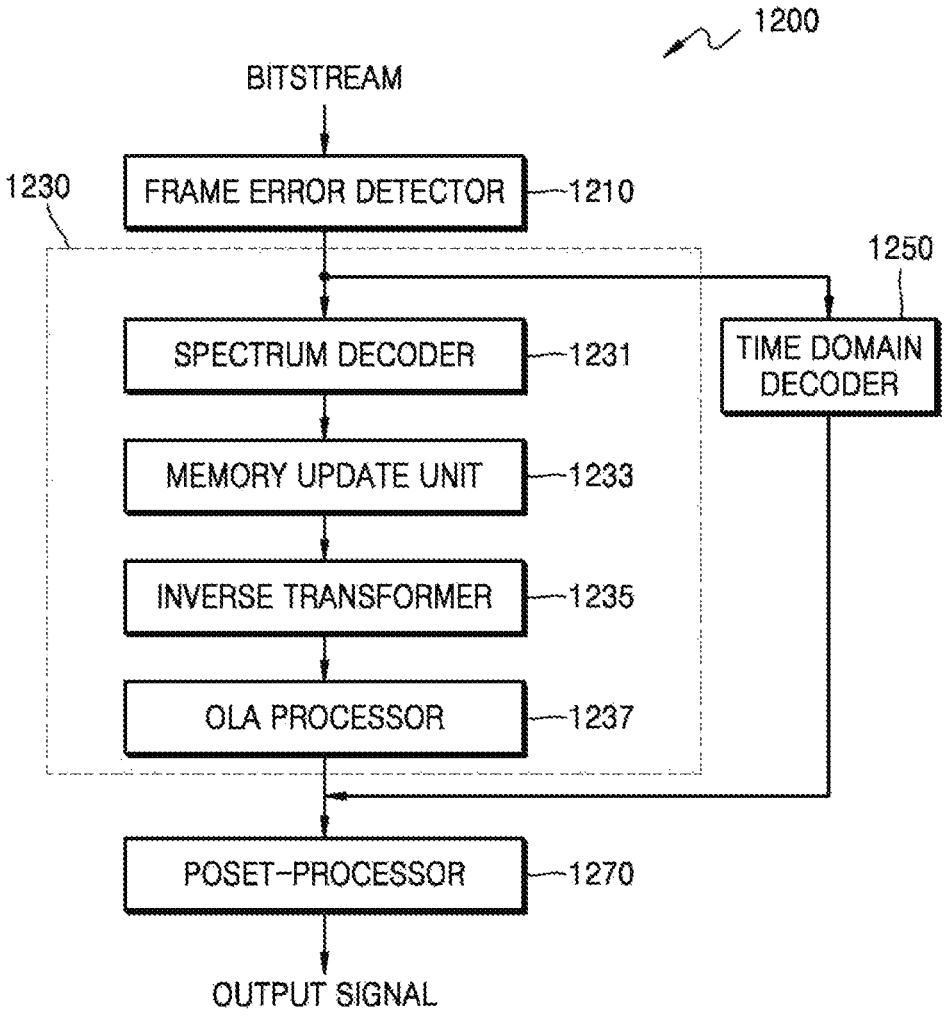
FIG. 12 is a block diagram of a frequency domain audio decoding apparatus according to an exemplary embodiment.

FIG. 12 is a block diagram of a frequency domain audio decoding apparatus according to an exemplary embodiment.

The frequency domain audio decoding apparatus 1200 shown in FIG. 12 may include a frame error detector 1210, a frequency domain decoder 1230, a time domain decoder 1250, and a post-processor 1270. The frequency domain decoder 1230 may include a spectrum decoder 1231, a memory update unit 1233, an inverse transformer 1235 and an overlap and add (OLA) unit 1237. The components may be integrated in at least one module and may be implemented as at least one processor (not shown).

Referring to FIG. 12, the frame error detector 1210 may detect whether a frame error occurs from a received bitstream.

The frequency domain decoder 1230 may operate when a coding mode is the music mode or the frequency domain mode and generate a time domain signal through a general transform decoding process when the frame error occurs and through a frame error concealment algorithm or a packet loss concealment algorithm when the frame error does not occur. In detail, the spectrum 1231 may synthesize spectral coefficients by performing spectral decoding based on a decoded parameter. The spectrum decoder 1033 will be described below in more detail with reference to FIGS. 13 and 14.

The memory update unit 1233 may update, for a next frame, the synthesized spectral coefficients, information obtained using the decoded parameter, the number of error frames which have continuously occurred until the present, information on a signal characteristic or a frame type of each frame, and the like with respect to the current frame that is a good frame. The signal characteristic may include a transient characteristic or a stationary characteristic, and the frame type may include a transient frame, a stationary frame, or a harmonic frame.

The inverse transformer 1235 may generate a time domain signal by performing a time-frequency inverse transform on the synthesized spectral coefficients.

The OLA unit 1237 may perform an OLA processing by using a time domain signal of a previous frame, generate a final time domain signal of the current frame as a result of the OLA processing, and provide the final time domain signal to a post-processor 1270.

The time domain decoder 1250 may operate when the coding mode is the speech mode or the time domain mode and generate a time domain signal by performing a general CELP decoding process when the frame error does not occur and performing a frame error concealment algorithm or a packet loss concealment algorithm when the frame error occurs.

The post-processor 1270 may perform filtering, up-sampling, or the like for the time domain signal provided from the frequency domain decoder 1230 or the time domain decoder 1250, but is not limited thereto. The post-processor 1270 provides a reconstructed audio signal as an output signal.

Figure 13:
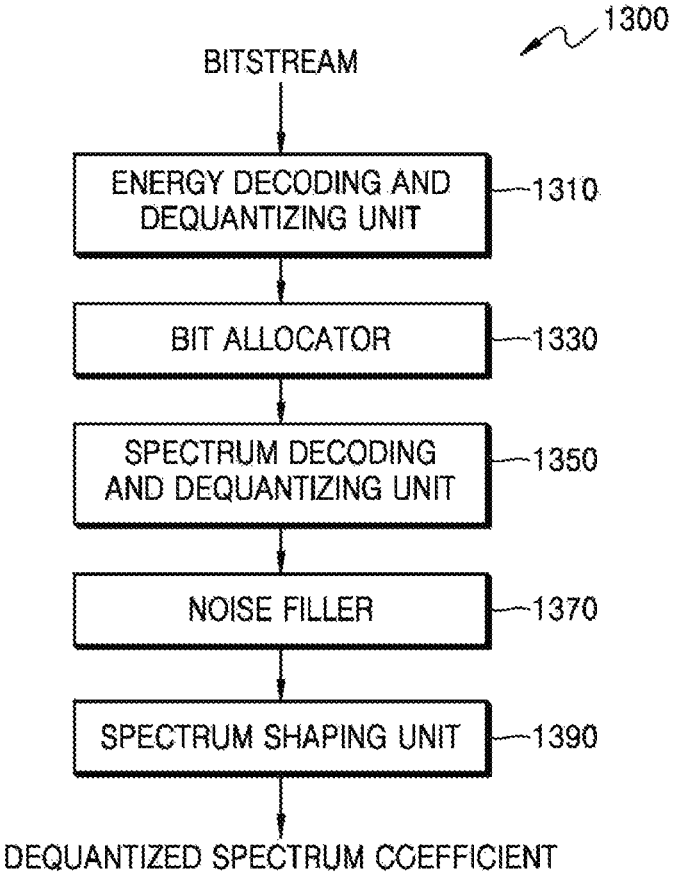
FIG. 13 is a block diagram of a spectrum decoding apparatus according to an exemplary embodiment.

FIG. 13 is a block diagram of a spectrum decoding apparatus according to an exemplary embodiment.

The spectrum decoding apparatus 1300 shown in FIG. 13 may include an energy decoding and dequantizing unit 1310, a bit allocator 1330, a spectrum decoding and dequantizing unit 1350, a noise filler 1370 and a spectrum shaping unit 1390. The noise filler 1370 may be at a rear end of the spectrum shaping unit 1390. The components may be integrated in at least one module and may be implemented as at least one processor (not shown).

Referring to FIG. 13, the energy decoding and dequantizing unit 1310 may perform lossless decoding on a parameter on which lossless coding is performed in an encoding process, for example, energy such as a Norm value and dequantize the decoded Norm value. In the encoding process, the Norm value may be quantized using one of various methods, e.g., vector quantization (VQ), scalar quantization (SQ), trellis coded quantization (TCQ), lattice vector quantization (LVQ), and the like, and in a decoding process, the Norm vale may be dequantized using a corresponding method.

The bit allocator 1330 may allocate required bits in sub-band units based on the quantized Norm value or the dequantized Norm value. In this case, the number of bits allocated in sub-band units may be the same as the number of bits allocated in the encoding process.

The spectrum decoding and dequantizing unit 1350 may generate normalized spectral coefficients by performing lossless decoding on encoded spectral coefficients based on the number of bits allocated in sub-band units and dequantizing the decoded spectral coefficients.

The noise filler 1370 may fill noises in a part requiring noise filling in sub-band units from among the normalized spectral coefficients.

The spectrum shaping unit 1390 may shape the normalized spectral coefficients by using the dequantized Norm value. Finally decoded spectral coefficients may be obtained through the spectrum shaping process.

Figure 14:
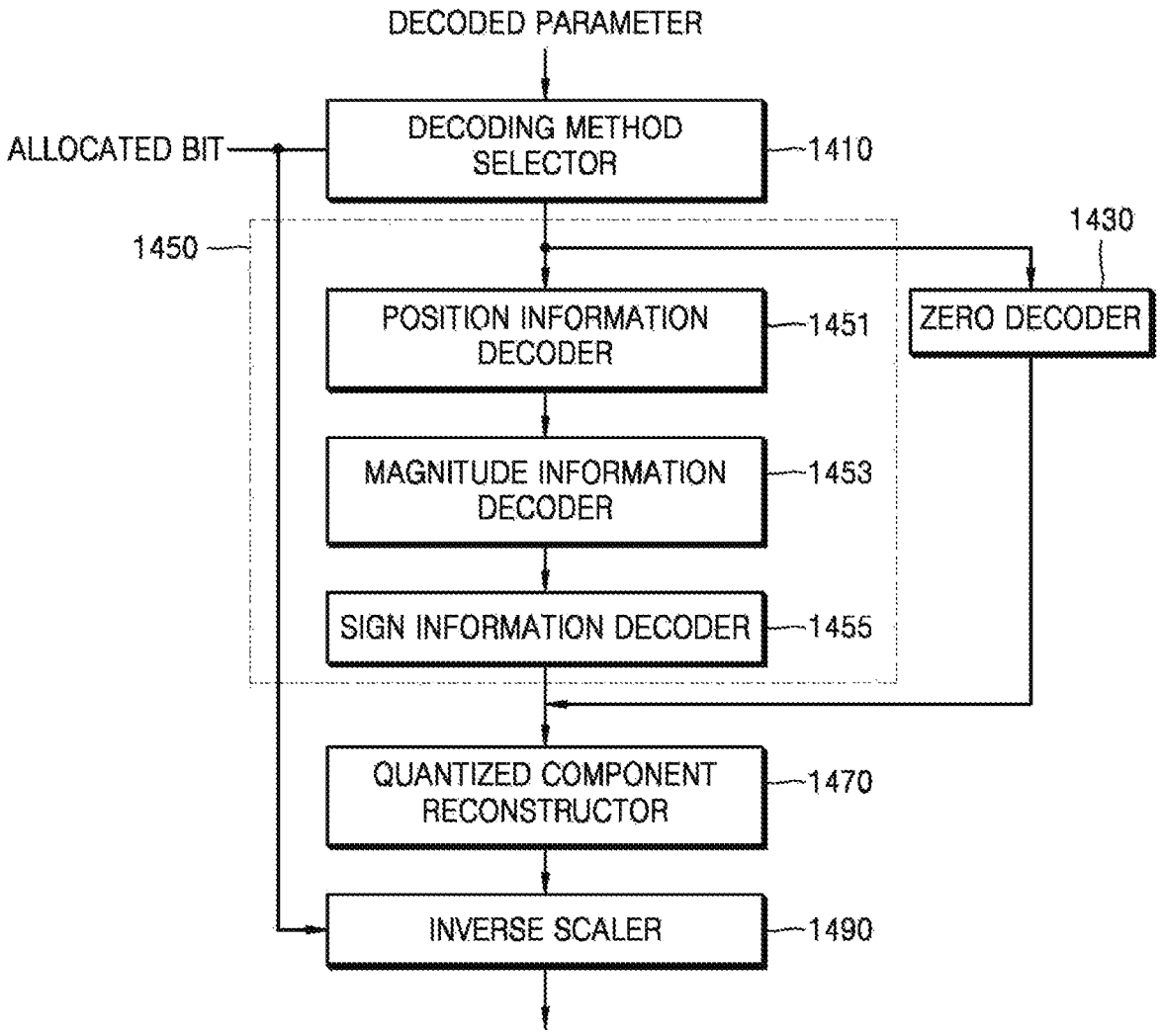
FIG. 14 is a block diagram of a spectrum decoding and dequantizing apparatus according to an exemplary embodiment.

FIG. 14 is a block diagram of a spectrum decoding and dequantizing apparatus 1400 according to an exemplary embodiment. The spectrum decoding and dequantizing apparatus 1400 of FIG. 14 may correspond to the spectrum decoding and dequantizing unit 1350 of FIG. 13, may be included in another frequency domain decoding apparatus, or may be implemented independently.

The spectrum decoding and dequantizing apparatus 1400 of FIG. 14 may include a decoding method selector 1410, a zero decoder 1430, a coefficient decoder 1450, a quantized component reconstructor 1470, and an inverse scaler 1490. The coefficient decoder 1450 may include a position information decoder 1451, a magnitude information decoder 1453, and a sign information decoder 1455.

Referring to FIG. 14, the decoding method selector 1410 may select a decoding method, based on a bit allocation for each band. A normalized spectrum may be supplied to the zero decoder 1430 or the coefficient decoder 1450, based on a decoding method which is selected for each band.

The zero decoder 1430 may decode all samples into 0 for a band where an allocated bit is 0.

The coefficient decoder 1450 may perform decoding by using a quantizer which is selected for a band where an allocated bit is not 0. The coefficient decoder 1450 may obtain information of an important spectral component in band units for an encoded spectrum and decode information of the obtained information of the important spectral component, based on a number, a position, a magnitude, and a sign. A magnitude of an important spectral component may be decoded by a scheme which differs from a scheme of decoding a number, a position, and a sign. For example, a magnitude of an important spectral component may be arithmetic-decoded and dequantized by using one selected from the USQ and the TCQ, and arithmetic decoding may be performed for a number, a position, and a sign of the important spectral component. A selection of a dequantizer may be performed by using the same result as the coefficient coder 950 of FIG. 9. The coefficient decoder 1450 may dequantize a band, where an allocated bit is not 0, by using one selected from the USQ and the TCQ.

The position information decoder 1451 may decode an index associated with position information included in a bitstream to restore a number and a position of ISCs. The arithmetic decoding may be used for decoding the position information. The magnitude information decoder 1453 may perform the arithmetic decoding on the index associated with the magnitude information included in the bitstream, and dequantize the decoded index by using one selected from the USQ and the TCQ. Nonzero position information and the number of ISCs may be used for enhancing an efficiency of the arithmetic decoding. The sign information decoder 1455 may decode an index associated with sign information included in the bitstream to restore a sign of ISCs. The arithmetic decoding may be used for decoding the sign information. According to an exemplary embodiment, the number of pulses necessary for a nonzero band may be estimated, and may be used for decoding magnitude information or sign information.

The quantized component reconstructor 1470 may recover an actual quantized component, based on information about the restored position, magnitude, and sign of the ISC. Here, 0 may be allocated to a zero position, namely, an unquantized part which is a spectral coefficient decoded into 0.

The inverse scaler 1490 may perform inverse scaling on the recovered quantized component to output a quantized spectral coefficient having the same level as that of the normalized spectrum.

Figure 15:
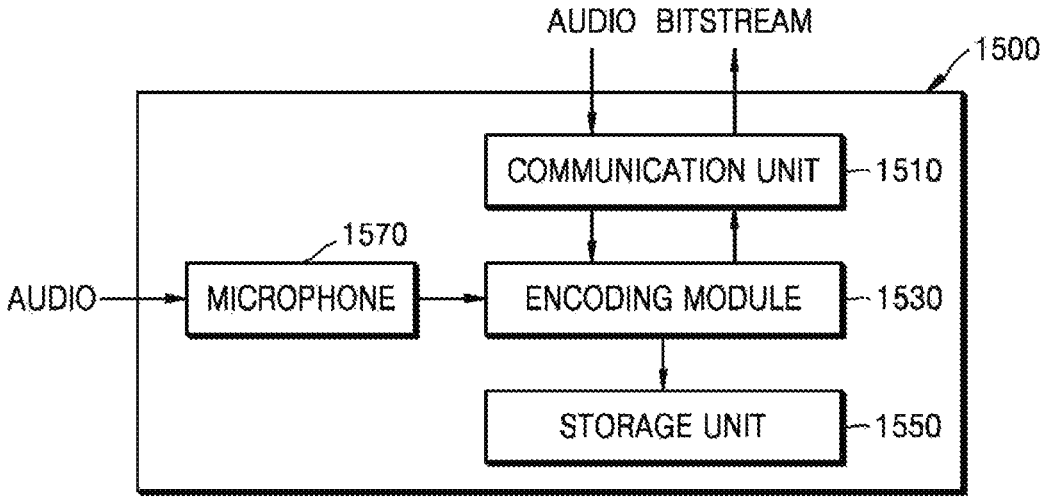
FIG. 15 is a block diagram of a multimedia device according to an exemplary embodiment.

FIG. 15 is a block diagram of a multimedia device including an encoding module, according to an exemplary embodiment.

Referring to FIG. 15, the multimedia device 1500 may include a communication unit 1510 and the encoding module 1530. In addition, the multimedia device 1500 may further include a storage unit 1550 for storing an audio bitstream obtained as a result of encoding according to the usage of the audio bitstream. Moreover, the multimedia device 1500 may further include a microphone 1570. That is, the storage unit 1550 and the microphone 1570 may be optionally included. The multimedia device 1500 may further include an arbitrary decoding module (not shown), e.g., a decoding module for performing a general decoding function or a decoding module according to an exemplary embodiment. The encoding module 1530 may be implemented by at least one processor (not shown) by being integrated with other components (not shown) included in the multimedia device 1500 as one body.

The communication unit 1510 may receive at least one of an audio signal or an encoded bitstream provided from the outside or may transmit at least one of a reconstructed audio signal or an encoded bitstream obtained as a result of encoding in the encoding module 1530.

The communication unit 1510 is configured to transmit and receive data to and from an external multimedia device or a server through a wireless network, such as wireless Internet, wireless intranet, a wireless telephone network, a wireless Local Area Network (LAN), Wi-Fi, Wi-Fi Direct (WFD), third generation (3G), fourth generation (4G), Bluetooth, Infrared Data Association (IrDA), Radio Frequency Identification (RFID), Ultra WideBand (UWB), Zigbee, or Near Field Communication (NFC), or a wired network, such as a wired telephone network or wired Internet.

According to an exemplary embodiment, the encoding module 1530 may select an ISC in band units for a normalized spectrum and encode information of the selected important spectral component for each band, based on a number, a position, a magnitude, and a sign. A magnitude of an important spectral component may be encoded by a scheme which differs from a scheme of encoding a number, a position, and a sign. For example, a magnitude of an important spectral component may be quantized and arithmetic-coded by using one selected from USQ and TCQ, and a number, a position, and a sign of the important spectral component may be coding by arithmetic coding. According to an exemplary embodiment, the encoding module 1530 may perform scaling on the normalized spectrum based on bit allocation for each band and select an ISC from the scaled spectrum.

The storage unit 1550 may store the encoded bitstream generated by the encoding module 1530. In addition, the storage unit 1550 may store various programs required to operate the multimedia device 1500.

The microphone 1570 may provide an audio signal from a user or the outside to the encoding module 1530.

Figure 16:
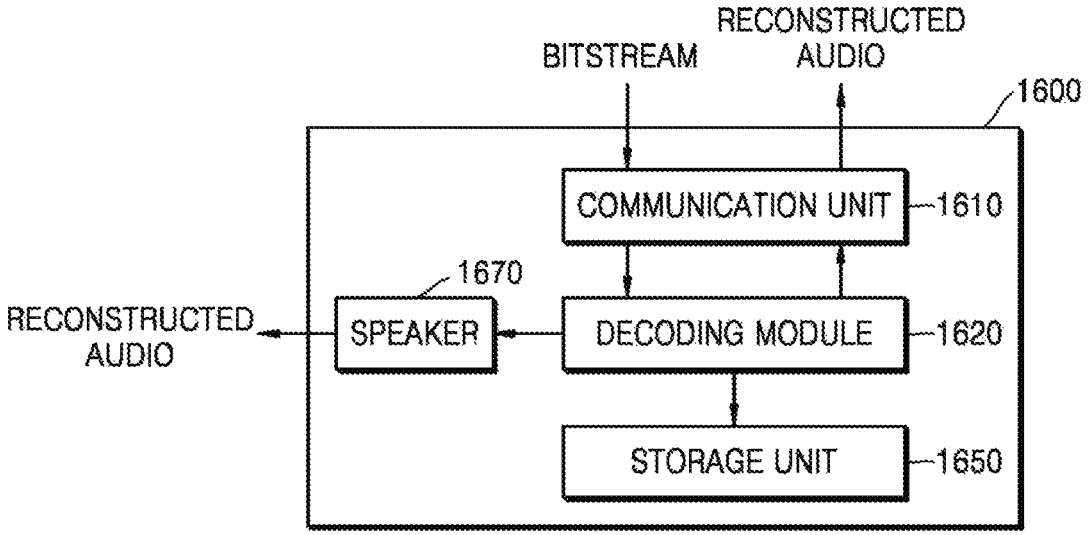
FIG. 16 is a block diagram of a multimedia device according to another exemplary embodiment.

FIG. 16 is a block diagram of a multimedia device including a decoding module, according to an exemplary embodiment.

Referring to FIG. 16, the multimedia device 1600 may include a communication unit 1610 and a decoding module 1630. In addition, according to the usage of a reconstructed audio signal obtained as a result of decoding, the multimedia device 1600 may further include a storage unit 1650 for storing the reconstructed audio signal. In addition, the multimedia device 1600 may further include a speaker 1670. That is, the storage unit 1650 and the speaker 1670 may be optionally included. The multimedia device 1600 may further include an encoding module (not shown), e.g., an encoding module for performing a general encoding function or an encoding module according to an exemplary embodiment. The decoding module 1630 may be implemented by at least one processor (not shown) by being integrated with other components (not shown) included in the multimedia device 1600 as one body.

The communication unit 1610 may receive at least one of an audio signal or an encoded bitstream provided from the outside or may transmit at least one of a reconstructed audio signal obtained as a result of decoding in the decoding module 1630 or an audio bitstream obtained as a result of encoding. The communication unit 1610 may be implemented substantially and similarly to the communication unit 1510 of FIG. 15.

According to an exemplary embodiment, the decoding module 1630 may receive a bitstream provided through the communication unit 1610 and obtain information of an important spectral component in band units for an encoded spectrum and decode information of the obtained information of the important spectral component, based on a number, a position, a magnitude, and a sign. A magnitude of an important spectral component may be decoded by a scheme which differs from a scheme of decoding a number, a position, and a sign. For example, a magnitude of an important spectral component may be arithmetic-decoded and dequantized by using one selected from the USQ and the TCQ, and arithmetic decoding may be performed for a number, a position, and a sign of the important spectral component.

The storage unit 1650 may store the reconstructed audio signal generated by the decoding module 1630. In addition, the storage unit 1650 may store various programs required to operate the multimedia device 1600.

The speaker 1670 may output the reconstructed audio signal generated by the decoding module 1630 to the outside.

Figure 17:
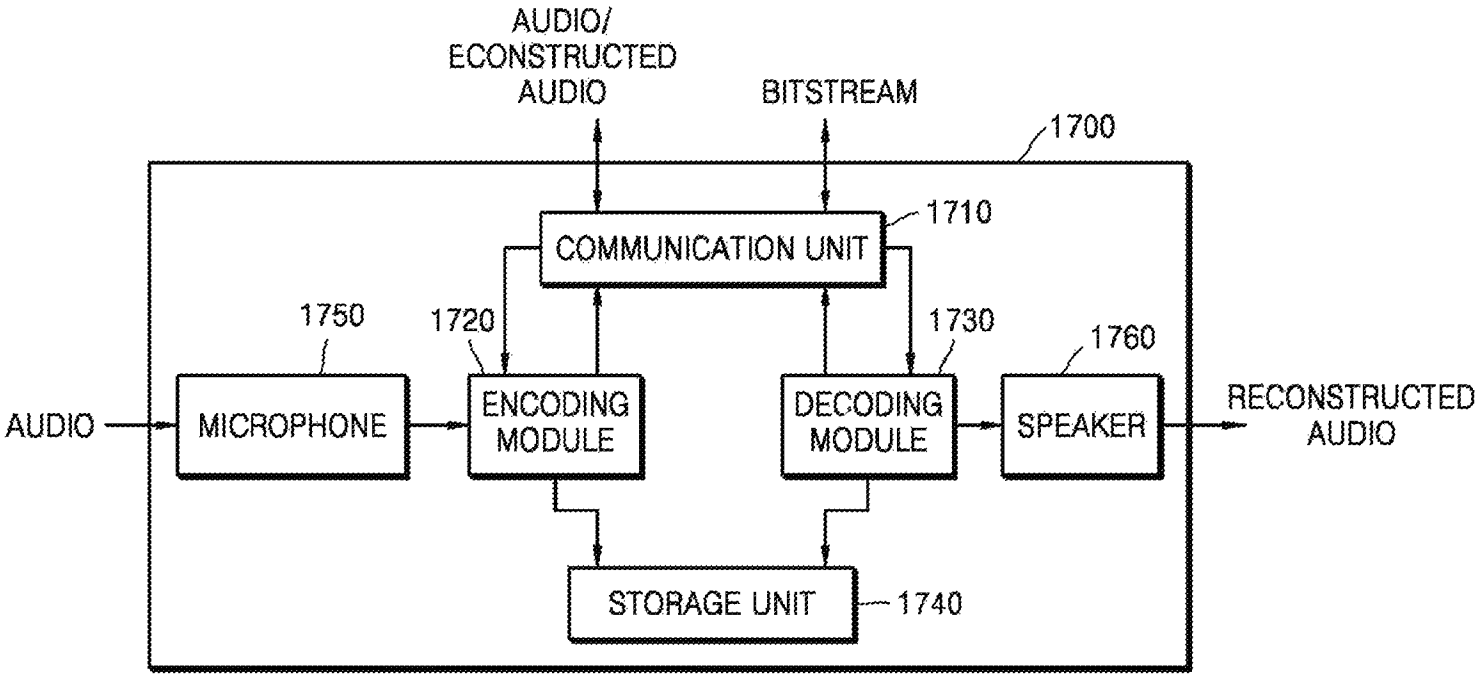
FIG. 17 is a block diagram of a multimedia device according to still another exemplary embodiment.

FIG. 17 is a block diagram of a multimedia device including an encoding module and a decoding module, according to an exemplary embodiment.

Referring to FIG. 17, the multimedia device 1700 may include a communication unit 1710, an encoding module 1720, and a decoding module 1730. In addition, the multimedia device 1700 may further include a storage unit 1740 for storing an audio bitstream obtained as a result of encoding or a reconstructed audio signal obtained as a result of decoding according to the usage of the audio bitstream or the reconstructed audio signal. In addition, the multimedia device 1700 may further include a microphone 1750 and/or a speaker 1760. The encoding module 1720 and the decoding module 1730 may be implemented by at least one processor (not shown) by being integrated with other components (not shown) included in the multimedia device 1700 as one body.

Since the components of the multimedia device 1700 shown in FIG. 17 correspond to the components of the multimedia device 1500 shown in FIG. 15 or the components of the multimedia device 1600 shown in FIG. 16, a detailed description thereof is omitted.

Each of the multimedia devices 1500, 1600, and 1700 shown in FIGS. 15, 16, and 17 may include a voice communication dedicated terminal, such as a telephone or a mobile phone, a broadcasting or music dedicated device, such as a TV or an MP3 player, or a hybrid terminal device of a voice communication dedicated terminal and a broadcasting or music dedicated device but are not limited thereto. In addition, each of the multimedia devices 1500, 1600, and 1700 may be used as a client, a server, or a transducer displaced between a client and a server.

When the multimedia device 1500, 1600, or 1700 is, for example, a mobile phone, although not shown, the multimedia device 1500, 1600, or 1700 may further include a user input unit, such as a keypad, a display unit for displaying information processed by a user interface or the mobile phone, and a processor for controlling the functions of the mobile phone. In addition, the mobile phone may further include a camera unit having an image pickup function and at least one component for performing a function required for the mobile phone.

When the multimedia device 1500, 1600, or 1700 is, for example, a TV, although not shown, the multimedia device 1500, 1600, or 1700 may further include a user input unit, such as a keypad, a display unit for displaying received broadcasting information, and a processor for controlling all functions of the TV. In addition, the TV may further include at least one component for performing a function of the TV.

The above-described exemplary embodiments may be written as computer-executable programs and may be implemented in general-use digital computers that execute the programs by using a non-transitory computer-readable recording medium. In addition, data structures, program instructions, or data files, which can be used in the embodiments, can be recorded on a non-transitory computer-readable recording medium in various ways. The non-transitory computer-readable recording medium is any data storage device that can store data which can be thereafter read by a computer system. Examples of the non-transitory computer-readable recording medium include magnetic storage media, such as hard disks, floppy disks, and magnetic tapes, optical recording media, such as CD-ROMs and DVDs, magneto-optical media, such as optical disks, and hardware devices, such as ROM, RAM, and flash memory, specially configured to store and execute program instructions. In addition, the non-transitory computer-readable recording medium may be a transmission medium for transmitting signal designating program instructions, data structures, or the like. Examples of the program instructions may include not only mechanical language codes created by a compiler but also high-level language codes executable by a computer using an interpreter or the like.

While the exemplary embodiments have been particularly shown and described, it will be understood by those of ordinary skill in the art that various changes in form and details may be made therein without departing from the spirit and scope of the inventive concept as defined by the appended claims. It should be understood that the exemplary embodiments described therein should be considered in a descriptive sense only and not for purposes of limitation. Descriptions of features or aspects within each exemplary embodiment should typically be considered as available for other similar features or aspects in other exemplary embodiments.

What is claimed is:

1. An encoding apparatus for an audio signal, the encoding apparatus comprising:

a memory storing instructions; and at least one processor configured to execute the instructions to:

perform scaling on a normalized spectrum based on bit allocation of a band;

select at least one important spectral component from the scaled spectrum of the band; and encode a magnitude of the selected at least one important spectral component, and at least one of a number, a position and a sign of the selected at least one important spectral component, wherein the magnitude of the selected at least one important spectral component is encoded using one selected from trellis coded quantization and uniform scalar quantization, wherein the at least one of the number, the position and the sign of the selected important spectral component is encoded using an arithmetic coding, wherein if an average number of bits for samples in the band is greater than or equal to a predetermined value, the uniform scalar quantization is selected, and wherein if the average number of bits for samples in the band is less than the predetermined value, the trellis coded quantization is selected.

2. The encoding apparatus of claim 1, wherein the trellis coded quantization uses an 8-state 4-coset trellis structure with 2 zero levels.

3. The encoding apparatus of claim 1, wherein if the bit allocation for the band is zero, all samples included in the band are encoded to zero.

4. A decoding apparatus for an audio signal, the decoding apparatus comprising:

a memory storing instructions; and at least one processor configured to execute the instructions to:

obtain, from a bitstream, information about at least one important spectral component for a normalized spectrum of a band; and decode the obtained information of the at least one important spectral component based on a magnitude of the at least one important spectral component, and at least one of a number, a position and a sign of the at least one important spectral component to recover spectral components, wherein the magnitude of the at least one important spectral component is decoded by using a dequantization scheme which is one selected from trellis coded quantization and uniform scalar quantization, wherein the at least one of the number, the position and the sign of the at least one important spectral component is decoded by using an arithmetic decoding, wherein the recovered spectral components are inverse-scaled, wherein if an average number of bits for samples in the band is greater than or equal to a predetermined value, the uniform scalar quantization is selected, and wherein if the average number of bits for samples in the band is less than the predetermined value, the trellis coded quantization is selected.

5. The decoding apparatus of claim 4, wherein the trellis coded quantization uses an 8-state 4-coset trellis structure with 2 zero levels.

6. The decoding apparatus of claim 4, wherein if a bit allocation for the band is zero, all samples included in the band are decoded to zero.

* * * * *